US012414638B2

(12) United States Patent
Karschnik et al.

(10) Patent No.: US 12,414,638 B2
(45) Date of Patent: Sep. 16, 2025

(54) MATTRESS WITH STACKED AIR CHAMBERS

(71) Applicant: Sleep Number Corporation, Minneapolis, MN (US)

(72) Inventors: Kody Lee Karschnik, Plymouth, MN (US); Saurabh Chhaparwal, Plymouth, MN (US)

(73) Assignee: Sleep Number Corporation, Minneapolis, MN (US)

( * ) Notice: Subject to any disclaimer, the term of this patent is extended or adjusted under 35 U.S.C. 154(b) by 257 days.

(21) Appl. No.: 17/862,836

(22) Filed: Jul. 12, 2022

(65) Prior Publication Data

US 2023/0017015 A1 Jan. 19, 2023

Related U.S. Application Data

(60) Provisional application No. 63/223,235, filed on Jul. 19, 2021.

(51) Int. Cl.
*A47C 27/10* (2006.01)
*A47C 27/08* (2006.01)

(52) U.S. Cl.
CPC ..... *A47C 27/10* (2013.01); *A47C 27/088* (2013.01)

(58) Field of Classification Search
CPC ..... A47C 27/08; A47C 27/081; A47C 27/082; A47C 27/083; A47C 27/084;
(Continued)

(56) References Cited

U.S. PATENT DOCUMENTS 4,193,149 A * 3/1980 Welch ..... A61G 7/05776 5/713
4,449,261 A 5/1984 Magnusson
(Continued)

FOREIGN PATENT DOCUMENTS

DE 2424440 12/1974
FR 2743995 8/1997
(Continued)

OTHER PUBLICATIONS

U.S. Appl. No. 09/471,592, Shafer, filed Dec. 23, 1999.
(Continued)

*Primary Examiner* — George Sun
(74) *Attorney, Agent, or Firm* — Fish & Richardson P.C.

(57) ABSTRACT

Disclosed are beds having stackable air chambers. A mattress can include a first air chamber, a second air chamber stacked beneath the first air chamber and fluidly connected to the first air chamber, and a support stacked beneath the first air chamber and positioned between the second air chamber and a foot end of the mattress. The first air chamber can extend across a length of the mattress from a head end to the foot end of the mattress. The second air chamber can be positioned at a shoulder region of the mattress. The first and second air chambers can have a common internal pressure, such that decreasing the pressure in the first and second air chambers cause the support stacked beneath the first air chamber and positioned between the second air chamber and the foot end of the mattress to increase support at a lumbar region of the mattress.

23 Claims, 18 Drawing Sheets

(58) Field of Classification Search
CPC ... A47C 27/085; A47C 27/087; A47C 27/088; A47C 27/10; A47C 27/14; A47C 27/144; A47C 27/15; A47C 27/18
See application file for complete search history.

(56) References Cited

U.S. PATENT DOCUMENTS 4,644,597 A 2/1987 Walker
4,766,628 A 8/1988 Walker
4,788,729 A 12/1988 Walker
D300,194 S 3/1989 Walker
4,829,616 A 5/1989 Walker
4,890,344 A 1/1990 Walker
4,897,890 A 2/1990 Walker
4,908,895 A 3/1990 Walker
D313,973 S 1/1991 Walker
4,991,244 A 2/1991 Walker
5,105,488 A * 4/1992 Hutchinson ..... A47C 27/064 5/652
5,144,706 A 9/1992 Walker
5,170,522 A 12/1992 Walker
5,231,717 A * 8/1993 Scott ..... A47C 31/123 5/400
5,282,286 A * 2/1994 MacLeish ..... A61G 5/1045 5/655.3
5,421,044 A * 6/1995 Steensen ..... A47C 27/18 5/713
D368,475 S 4/1996 Scott
5,509,154 A 4/1996 Shafer et al.
5,564,140 A 10/1996 Shoenhair et al.
5,642,546 A 7/1997 Shoenhair
5,652,484 A 7/1997 Shafer et al.
5,666,681 A * 9/1997 Meyer ..... A61G 7/05769 5/624
5,765,246 A 6/1998 Shoenhair
5,829,081 A * 11/1998 Pearce ..... A61G 5/1045 5/654
5,903,941 A 5/1999 Shafer et al.
5,904,172 A 5/1999 Gifft et al.
6,037,723 A 3/2000 Shafer et al.
6,085,372 A * 7/2000 James ..... A61G 7/05784 5/713
6,108,844 A 8/2000 Kraft et al.
6,161,231 A 12/2000 Kraft et al.
6,202,239 B1 * 3/2001 Ward ..... A47C 27/082 5/724
6,397,419 B1 6/2002 Mechache
6,483,264 B1 11/2002 Shafer et al.
6,686,711 B2 2/2004 Rose et al.
6,708,357 B2 3/2004 Gaboury et al.
6,763,541 B2 7/2004 Mahoney et al.
6,804,848 B1 * 10/2004 Rose ..... A47C 27/18 5/710
6,807,698 B2 * 10/2004 Torbet ..... A47C 27/082 5/730
6,832,397 B2 12/2004 Gaboury et al.
D502,929 S 3/2005 Copeland et al.
6,883,191 B2 4/2005 Gaboury et al.
7,036,172 B2 * 5/2006 Torbet ..... A47C 27/082 5/736
7,360,266 B2 4/2008 Kasatshko
7,389,554 B1 6/2008 Rose
7,849,544 B2 * 12/2010 Flocard ..... A61G 7/05769 5/713
7,865,988 B2 1/2011 Koughan et al.
8,201,292 B2 6/2012 Dionne et al.
8,336,369 B2 12/2012 Mahoney
D691,118 S 10/2013 Ingham et al.
D697,874 S 1/2014 Stusynski et al.
D698,338 S 1/2014 Ingham et al.
D701,536 S 3/2014 Shakal et al.
8,769,747 B2 7/2014 Mahoney et al.
8,893,339 B2 11/2014 Fleury et al.
8,931,329 B2 1/2015 Mahoney et al.
8,966,689 B2 3/2015 McGuire et al.
8,973,183 B1 3/2015 Palashewski et al.
D728,254 S 5/2015 Blazar et al.
9,078,795 B1 * 7/2015 Wilkinson ..... A61G 7/05776
D737,250 S 8/2015 Ingham et al.
9,314,118 B2 4/2016 Blazar et al.
9,578,941 B2 2/2017 MacLachlan et al.
9,730,524 B2 8/2017 Chen et al.
9,737,154 B2 8/2017 Mahoney et al.
D809,843 S 2/2018 Keeley et al.
D812,393 S 3/2018 Karschnik et al.
9,924,813 B1 3/2018 Basten et al.
10,143,312 B2 12/2018 Brosnan et al.
D840,732 S 2/2019 Peterson et al.
10,194,753 B2 2/2019 Fleury et al.
10,285,508 B2 5/2019 Rose et al.
D857,433 S 8/2019 Kiekhoefer et al.
10,531,745 B2 1/2020 McGuire et al.
10,539,170 B2 1/2020 Peterson et al.
10,575,654 B2 3/2020 Shakal
10,677,232 B2 6/2020 Shakal et al.
10,729,253 B1 8/2020 Gaunt
10,765,224 B2 9/2020 Chen et al.
10,813,470 B2 10/2020 Mahoney et al.
10,888,173 B2 1/2021 Shakal et al.
10,993,546 B2 5/2021 Shakal et al.
11,001,447 B2 5/2021 Shutes et al.
11,085,479 B2 8/2021 Griffith et al.
11,096,502 B2 8/2021 Rose et al.
D932,808 S 10/2021 Keeley
11,140,999 B2 10/2021 Peterson et al.
11,229,297 B2 1/2022 Gaunt
2002/0069462 A1 6/2002 Gaboury et al.
2002/0129448 A1 * 9/2002 Pirzada ..... A47C 27/081 5/713
2003/0192127 A1 * 10/2003 Cook ..... A47C 27/082 5/713
2003/0221261 A1 * 12/2003 Torbet ..... A47C 27/082 5/709
2004/0172767 A1 9/2004 Mossbeck et al.
2005/0204475 A1 9/2005 Schmitz et al.
2005/0235417 A1 10/2005 Koughan et al.
2008/0052830 A1 3/2008 Koughan et al.
2010/0043148 A1 2/2010 Rose et al.
2011/0163885 A1 7/2011 Poulos et al.
2011/0173758 A1 7/2011 Fontaine
2012/0096648 A1 * 4/2012 Chan ..... A47C 27/001 5/715
2013/0025068 A1 * 1/2013 Chunglo ..... A47C 27/14 5/739
2014/0250597 A1 9/2014 Chen et al.
2014/0310881 A1 * 10/2014 Wyatt ..... A61G 7/05784 5/709
2015/0007393 A1 1/2015 Palashewski
2015/0182418 A1 7/2015 Zaiss
2015/0289667 A1 * 10/2015 Oakhill ..... A47C 27/18 5/423
2017/0156519 A1 * 6/2017 Cheng ..... A47C 7/383
2018/0125259 A1 5/2018 Peterson et al.
2019/0082855 A1 3/2019 Brosnan et al.
2019/0290013 A1 * 9/2019 Boyd ..... A47C 27/083
2020/0187667 A1 6/2020 Shakal
2020/0268163 A1 * 8/2020 Duvert ..... A47C 27/083
2020/0359805 A1 11/2020 Brosnan et al.
2020/0375369 A1 12/2020 Negus et al.
2020/0400135 A1 12/2020 Shakal et al.
2021/0145183 A1 5/2021 Negus et al.
2021/0145185 A1 5/2021 Negus et al.
2021/0177155 A1 6/2021 McGuire et al.
2021/0244196 A1 8/2021 Hilden et al.
2021/0244197 A1 * 8/2021 Oswald ..... A47C 27/15
2021/0251392 A1 8/2021 Shakal
2021/0330090 A1 10/2021 Shakal et al.
2021/0341006 A1 11/2021 Griffith et al.
2021/0378413 A1 * 12/2021 Ohno ..... A47C 27/083
2022/0167753 A1 * 6/2022 Rasmussen ..... A47C 27/05
2022/0192388 A1 6/2022 Smith et al.
2022/0218116 A1 7/2022 Rose et al.
2022/0273118 A1 9/2022 Peterson et al.

(56) References Cited

U.S. PATENT DOCUMENTS

| | | | | |
|---|---|---|---|---|
| 2022/0296002 | A1* | 9/2022 | Long | A47C 27/15 |
| 2022/0322840 | A1 | 10/2022 | Gaunt | |
| 2022/0369827 | A1 | 11/2022 | Rose et al. | |
| 2023/0027288 | A1 | 1/2023 | Karschnik | |
| 2023/0031563 | A1 | 2/2023 | Molina et al. | |

FOREIGN PATENT DOCUMENTS

| | | |
|---|---|---|
| FR | 2814653 | 4/2002 |
| WO | WO 2020/185308 | 9/2020 |

OTHER PUBLICATIONS

U.S. Appl. No. 14/594,843, Rose et al., filed Jan. 12, 2015.
U.S. Appl. No. 17/006,388, Stusynski et al. filed Oct. 31, 2022.
U.S. Appl. No. 17/410,424, Doffing et al., filed Aug. 24, 2021.
U.S. Appl. No. 17/743,857, Rose et al., filed May 13, 2022.
U.S. Appl. No. 17/859,189, Molina et al., filed Jul. 7, 2022.
U.S. Appl. No. 17/862,836, Karschnik et al., filed Jul. 12, 2022.
U.S. Appl. No. 17/891,573, Shakal, filed Aug. 19, 2022.
U.S. Appl. No. 17/968,983, Karschnik et al., filed Oct. 19, 2022.
U.S. Appl. No. 17/986,324, Negus et al., filed Nov. 14, 2022.
U.S. Appl. No. 18/091,813, Brosnan et al., filed Dec. 30, 2022.
U.S. Appl. No. 29/719,090, Negus et al., filed Dec. 31, 2019.
U.S. Appl. No. 29/807,154, Negus, filed Sep. 9, 2021.
U.S. Appl. No. 29/821,785, Negus et al., filed Jan. 3, 2022.

* cited by examiner

MATTRESS WITH STACKED AIR CHAMBERS

CROSS-REFERENCE TO RELATED APPLICATIONS

This application claims priority to U.S. Provisional Application Ser. No. 63/223,235, filed on Jul. 19, 2021, the disclosure of which is incorporated by reference in its entirety.

TECHNICAL FIELD

This document describes devices, systems, and methods related to mattresses with air chambers.

BACKGROUND

In general, a bed is a piece of furniture used for sleeping and relaxing. Many modern beds include a soft mattress on a bed frame. The mattress may include springs, foam material, and/or air chambers to support the weight of one or more users. Various features and systems have been used in conjunction with beds, including pressure adjustment systems for adjusting firmness of one or more users of the bed.

SUMMARY

The document generally relates to mattresses with multiple interconnected air chambers that can be spaced by foam or some other intermediary structure other than the air chambers. More specifically, the document relates to air mattress systems with a plurality of air chambers that can be stacked and positioned in such a way to provide support and sleeper spine alignment through a full range of firmness pressure settings.

Pressure distribution and support (e.g., spine alignment) can be impacted in differing ways when a firmness is increased or decreased for an air mattress system. In some air mattress systems, when air pressure is decreased in air chambers of the mattress, the mattress can become more comfortable but spine alignment can be reduced. Reduced spine alignment can cause decompression in portions of the user's body, which can negatively impact the user's sleep quality.

Some embodiments described herein include an air mattress system, which can have adjustable stacked air chambers designed to increase or decrease surface firmness while providing spine alignment and comfort for the user. The air chambers can be stacked and configured in a way to allow for improved pressure distribution while also targeting a supportive result for one or more users of the mattress system. For example, in some embodiments, two air chambers can be stacked at a shoulder region of the mattress system while maintaining one air chamber near the waist region. This configuration can be advantageous to provide for more support, pressure adjustment, spinal alignment, and/or user comfort preferences. Stacking chambers in the shoulder region of the mattress system can be advantageous to provide additional support to the shoulder region. In other embodiments, air chambers can be stacked wherever the user desires to have additional or more support and/or adjustability in pressure. For example, one user can prefer stacking air chambers near a hip or waist region of the mattress system to provide more support and adjustment to the hip or waist region. In some embodiments, the user can prefer stacking air chambers that extend substantially across an entire length of the mattress system.

In some embodiments, the stacked air chambers can be fluidly connected such that they share a common pressure. Moreover, in some embodiments, all the air chambers in the mattress system, whether or not they are stacked, can be fluidly connected to share a common pressure. In some embodiments, all the air chambers can be separately adjustable and therefore not share a common pressure. In some embodiments, for example, the air chamber at the waist region can be fluidly connected to one or more of the stacked air chambers at the shoulder region and can be independent of the other air chambers at the shoulder region such that the other air chambers at the shoulder region can be set to different pressures.

In some embodiments, a first air chamber can extend from a head region to a foot region of the mattress system. Above or below the first air chamber, one or more additional air chambers can be stacked in regions of interest of the mattress system. For example, a second air chamber can be stacked in the shoulder region of the mattress system to provide additional support and pressure adjustment in the shoulder region of the mattress system. As another example, a third air chamber can be stacked in the hip region of the mattress system to provide additional support and pressure adjustment in the hip region of the mattress system. In some embodiments, the first and second air chambers can be positioned in the mattress system as mentioned above but the third air chamber can be excluded. Instead, one or more foam inserts can be positioned next to the second air chamber, in the hip region of the mattress system. The foam inserts can extend from the second air chamber to the foot end of the mattress system. As described above, any of the first, second, and third air chambers can be fluidly connected such that they share a common pressure. In some embodiments, only some of the first, second, and third air chambers can be fluidly connected such that they share a common pressure.

In the mattress systems described herein, space between air chambers can be filled with a foam insert or other similar material and/or structure. In some embodiments, multiple foam inserts can be positioned between the air chambers. In some embodiments, one or more foam inserts can also be positioned between each of the air chambers and the head and/or foot ends of the mattress system. As an example, foam inserts can be positioned between a first air chamber in the shoulder region and a second air chamber in the hip region of the mattress system. A third air chamber can extend a length of the mattress system, from the head end to the foot end of the mattress system, and can be positioned directly on top of the first and second air chambers and the foam inserts. Thus, foam inserts may not be positioned between stacked air chambers. As another example, foam inserts can be positioned between the first air chamber in the shoulder region and the second air chamber in the hip region of the mattress system. A third air chamber can be stacked on top of the first air chamber in the shoulder region of the mattress system. Additional foam inserts can be positioned next to the third air chamber and extend from the third air chamber to the foot end of the mattress system, over the second air chamber and the foam inserts. In some embodiments, instead of stacking foam inserts, foam inserts of greater height can be positioned in mattress system where air chambers are not stacked.

In some embodiments, the mattress system can have two sections (e.g., left and right sections) to accommodate two users on the bed. Each of the sections can include a set of air chambers, which can be stacked as described herein, and one or more foam inserts. Pressure can then be adjusted for each section based on preferences of each of the two users.

Particular embodiments described herein include a mattress having a first air chamber, a second air chamber stacked beneath the first air chamber that is fluidly connected to the first air chamber, and a support stacked beneath the first air chamber and positioned between the second air chamber and a foot end of the mattress.

In some implementations, the mattress can optionally include one or more of the following features. For example, the mattress can also include a foam layer positioned at a top surface of the mattress above the first air chamber. The first air chamber can extend across a length of the mattress from a head end to the foot end of the mattress. Moreover, the second air chamber can be positioned at a shoulder region of the mattress.

As another example, the first air chamber and the second air chamber can have a common internal pressure. Decreasing the common internal pressure in the first air chamber and the second air chamber can cause the support stacked beneath the first air chamber and positioned between the second air chamber and the foot end of the mattress to increase support at a lumbar region of the mattress.

Sometimes, one or more additional supports can be positioned beneath the first air chamber and between at least one of (i) the second air chamber and a head end of the mattress, (ii) the second air chamber and the support, and (iii) the support and the foot end of the mattress. The mattress can sometimes include a third air chamber stacked beneath the first air chamber and positioned between the support and the foot end of the mattress, such that the third air chamber can be positioned at a hip region of the mattress. An additional support can also be positioned beneath the second air chamber and the support and configured to extend across a length of a bottom surface of the mattress.

As another example, the mattress can include a foam rail structure including a head portion, a foot portion, and first and second side portions, the foam rail structure stacked beneath the first air chamber and configured to extend around a perimeter of the mattress to surround the second air chamber and the support. The second air chamber can extend from a location adjacent to an inner surface of the head portion of the foam rail structure to a shoulder region of the mattress. The support can extend from a location adjacent to the second air chamber to a location adjacent to an inner surface of the foot portion of the foam rail structure.

Sometimes, the support can include a foam cushion. The support can also include a rectangular open cell foam cushion positioned between the second air chamber and the foot end of the mattress at a location exterior to the second air chamber.

As yet another example, the mattress can further include a first section extending longitudinally between a head end and the foot end of the mattress and extending laterally between a left side and a midline of the mattress, and a second section extending longitudinally between the head end and the foot end of the mattress and extending laterally between a right side and the midline of the mattress. The first section can include the second air chamber and the support, and the second section can include a third air chamber and a second support positioned between the third air chamber and the foot end of the mattress. The first air chamber can extend across a top surface of the first section and the second section. Sometimes, the second air chamber and the third air chamber can have a different internal pressure. Sometimes, the support within the first section can have a first firmness level and the second support within the second section can have a second firmness level, where the first firmness level is different than the second firmness level.

As another example, the mattress can further include a first section extending longitudinally between a head end and the foot end of the mattress and extending laterally between a left side and a midline of the mattress, and a second section extending longitudinally between the head end and the foot end of the mattress and extending laterally between a right side and the midline of the mattress. The first section can include the first air chamber, the second air chamber, and the support, and the second section comprises a third air chamber, a fourth air chamber, and a second support positioned between the fourth air chamber and the foot end of the mattress. The first air chamber can extend across a top surface of the first section and the third air chamber can extend across a top surface of the second section. Sometimes, the first air chamber and the third air chamber can be fluidly connected to share a first common pressure and the second air chamber and the fourth air chamber can be fluidly connected to share a second common pressure. The first common pressure can be different than the second common pressure.

One or more embodiments described herein include a mattress having a first air chamber, a second air chamber stacked beneath the first air chamber that is fluidly connected to the first air chamber, and a support stacked above the second air chamber and positioned between the first air chamber and a foot end of the mattress.

The mattress can include any one or more of the following features. The second air chamber can extend across a length of the mattress from a head end to the foot end of the mattress. The first air chamber can be positioned at a shoulder region of the mattress. The first air chamber and the second air chamber can have a common internal pressure. Moreover, one or more additional supports can be stacked above the second air chamber and positioned between at least one of (i) the first air chamber and a head end of the mattress, (ii) the first air chamber and the support, and (iii) the support and the foot end of the mattress. The mattress may also include a third air chamber stacked above the second air chamber and positioned between the support and the foot end of the mattress. The third air chamber can be positioned at a hip region of the mattress.

As another example, the mattress can also include a foam rail structure including a head portion, a foot portion, and first and second side portions, the foam rail structure configured to extend around a perimeter of the mattress. The foam rail structure can surround the first air chamber and the support. The foam rail structure can also surround the first air chamber, the second air chamber, and the support. The first air chamber can extend from a location adjacent to an inner surface of the head portion of the foam rail structure to a shoulder region of the mattress. The support can also extend from a location adjacent to the first air chamber to a location adjacent to an inner surface of the foot portion of the foam rail structure.

As yet another example, the mattress can include a first section extending longitudinally between a head end and the foot end of the mattress and extending laterally between a left side and a midline of the mattress, and a second section extending longitudinally between the head end and the foot end of the mattress and extending laterally between a right side and the midline of the mattress. The first section can include the first air chamber, the second air chamber, and the support, and the second section can include a third air chamber, a fourth air chamber, and a second support positioned between the third air chamber and the foot end of the mattress. The fourth air chamber can be stacked beneath the third air chamber and the second support. Moreover, the first air chamber and the fourth air chamber can be fluidly connected to share a first common pressure and the second air chamber and the third air chamber can be fluidly connected to share a second common pressure, such that the first common pressure can be different than the second common pressure.

One or more embodiments described herein can also include a mattress extending longitudinally between a head end and a foot end and extending laterally between a left side and a right side, the mattress having a first section extending longitudinally between the head end and the foot end and extending laterally between the left side and a midline of the mattress. The first section can include a first air chamber, a second air chamber stacked beneath the first air chamber, and a first support positioned between the first air chamber and the foot end of the mattress. The mattress can also have a second section extending longitudinally between the head end and the foot end and extending laterally between the right side and the midline of the mattress, the second section including a third air chamber, a fourth air chamber stacked beneath the third air chamber, and a second support positioned between the third air chamber and the foot end of the mattress.

The mattress can optionally include one or more of the following features. The first air chamber can be fluidly connected to the fourth air chamber so as to have a first common internal pressure in the first and fourth air chambers, and the second air chamber can be fluidly connected to the third air chamber so as to have a second common internal pressure in the second and third air chambers. Moreover, the first common internal pressure can be different than the second common internal pressure.

The mattress can also include a pump system having one or more air pumps fluidly connected to the first, second, third, and fourth air chambers. The pump system can inflate the first, second, third, and fourth air chambers. Sometimes, the mattress can include means for inflating the first, second, third, and fourth air chambers. Moreover, the mattress can include means for containing the first, second, third, and fourth air chambers, the first and second supports, and a foam layer positioned on top of each of the first, second, third, and fourth air chambers and the first and second supports.

One or more embodiments described herein can include a mattress having a first air chamber positioned on a first side of the mattress, a second air chamber positioned on a second side of the mattress, a first lower air chamber positioned under the first air chamber that is fluidly connected with the second air chamber, and a second lower air chamber positioned under the second air chamber that is fluidly connected with the first air chamber.

The mattress can include one or more of the following features. For example, each of the first air chamber, the second air chamber, the first lower air chamber, and the second lower air chamber can extend substantially an entire length of the mattress within a mattress cover. Each of the first air chamber, the second air chamber, the first lower air chamber, and the second lower air chamber can also have substantially the same length. Sometimes, each of the first air chamber and the second air chamber can be fluidly independent and independently adjustable. Moreover, the mattress can have a relatively level top sleep surface even when pressure is adjusted in the first air chamber and the second lower air chamber but not in the second air chamber and the first lower air chamber.

One or more embodiments described herein also include a mattress having a first air chamber, and a second air chamber stacked beneath the first air chamber. The second air chamber can be fluidly connected to the first air chamber. The mattress can include any one or more of the abovementioned features.

The devices, system, and techniques described herein may provide one or more of the following advantages. For example, the disclosed embodiments provide for improved spine alignment, stability, and surface continuity. For example, as air chamber pressure is uniformly decreased for all the air chambers in the mattress system, hip and shoulder regions can sink into the mattress, all while core and lumbar regions can remain supported by the foam support between the air chambers. As the air chambers deflate, the user's body can sink into the mattress more at regions of the air chambers, which can result in the foam providing more support to the user in waist/lumbar regions of the user's body. This added increased support in the waist and lumbar regions can enable an improved spine alignment for the user. Moreover, the improved spine alignment can be advantageous to improve overall sleep quality of the user. With better spine alignment, users can experience better sleep and more comfort.

As another example, some disclosed embodiments can provide for a relatively even and uniform sleep surface across a mattress system. For example, a mattress for two sleepers can have two sides. Each side can have stacked air chambers that extend substantially a length of the mattress system. A first user on a first side can adjust pressure in air chambers on the first side such that the first side is less firm. A second user on a second side can adjust pressure in air chambers on the second side such that the second side is more firm. When both sides of the mattress system are adjusted to different pressure levels, the sleep surface on top of the mattress system may be uneven. The disclosed embodiments, therefore, can provide for cross fluid connection between a top air chamber on the first side with a lower air chamber on the second side and a top air chamber on the second side with a lower air chamber on the first side. With cross fluid connection, when the air chamber on the first side is reduced in pressure for example, the lower air chamber on the second side can similarly be reduced in pressure in order to balance out the difference in pressure such that the sleep surface can be relatively even across the mattress system. Moreover, such minor adjustments in pressure to the lower air chambers may not be felt by the users. A relatively even sleep surface of the mattress system can be aesthetically pleasing and also more comfortable to users on both sides of the mattress system.

As another example, some disclosed embodiments can provide for user customization of the air mattress system. The air chambers and foam inserts can be movably positioned within a rail structure of the mattress. As a result, the user can move a position or location of any of the air chambers and the foam inserts. The user can also stack air chambers or prefer not to stack air chambers. The user can also swap out any one of the air chambers and foam inserts with other air chambers and/or foam inserts. For example, the user can insert one or more foam inserts having different firmness levels. The user may desire a firmer foam insert rather than a less firm foam insert. In other words, components of the air mattress system can be interchangeable by the user with increased and/or decreased firmness depending on the user's comfort preferences. The user can also insert multiple foam inserts in one or more regions in the mattress, between one or more of the air chambers and one or both of the head end and the foot end of the mattress. As another example, the components of the air mattress system can be moved or shifted between different zones or regions of the mattress system to accommodate for different user heights and/or comfort preferences. The user can change where any of the air chambers and/or the foam insert(s) are positioned within the mattress system. For example, a taller user can move the second air chamber closer to the foot end of the mattress to accommodate for their height. A shorter user can move the second air chamber closer to the head end of the mattress (e.g. closer to the first air chamber).

As another example, an air mattress system can have two sections, each with air chambers and foam insert(s) that can be customizable by two users of the bed. Therefore, when two users are sleeping in the bed, each user can adjust pressure settings for their respective air chambers. Each user can also move the air chambers and foam inserts in each of their respective sections. The disclosed embodiments can provide for each user to adjust their comfortability preferences independent of the other user.

As another example, the air chambers can be a same size, which can be cost effective in manufacturing and production of the air mattress system. The user can also replace or swap out one or more of the air chambers with differently sized chambers. Doing so can accommodate to the user's comfort preferences. For example, the user can swap out an air chamber with a longer air chamber that extends from the hip region to the foot end of the mattress.

In embodiments where two (or more) air chambers are fluidly connected, a single pressure setting can be used when adjusting firmness of the mattress, which can provide a relatively simple system for a user to adjust mattress firmness. Using a single pressure setting can also provide for consistent spinal alignment (as opposed to allowing different pressure settings in each chamber which can result in one chamber being undesirably firm as compared to another chamber). Therefore, parts of the user's body can be balanced across the top surface of the mattress system. Moreover, fluid connection of the air chambers can provide for less costly manufacturing and greater ease in maintenance or fixing components of the system as described herein.

The details of one or more implementations are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

This document generally relates to air mattress systems with foam or other suitable support and a plurality of air chambers that can be positioned and stacked in such a way to provide support and sleeper spine alignment through a range of firmness pressure settings.

Figure 1:
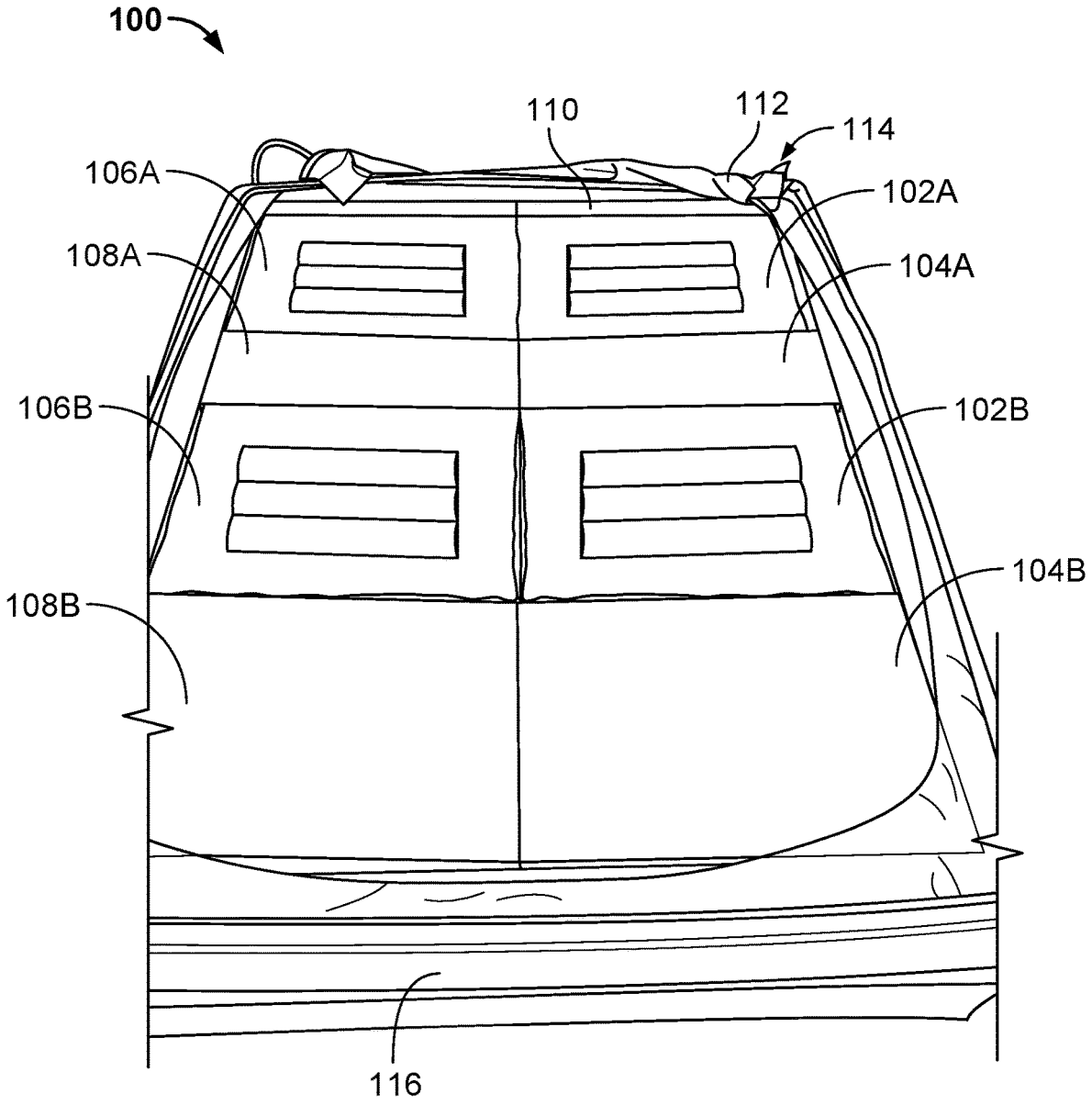
FIG. 1 is an example mattress system as described herein.

Referring to the figures, FIG. 1 is an example mattress system 100 as described herein. The mattress system 100 is depicted upside down to show components contained therein. The mattress system 100 can include a rail structure 110, a first air chamber 102A, a second air chamber 102B, a first foam insert 104A, a second foam insert 104B, a third air chamber 106A, a fourth air chamber 106B, a third foam insert 108A, and a fourth foam insert 108B. The first and second air chambers 102A and 102B and the first and second foam inserts 104A and 104B can be part of a first section of the mattress 100 that extends longitudinally between a head end 114 and a foot end 116 of the mattress system 100 and extends laterally between a right side and a midline of the mattress system 100. The third and fourth air chambers 106A and 106B and the third and fourth foam inserts 108A and 108B can be part of a second section of the mattress system 100 that extends longitudinally between the head end 114 and the foot end 116 of the mattress system 100 and extends laterally between a left side and the midline of the mattress system 100, as depicted in FIG. 1.

The rail structure 110 can be a foam structure positioned around a perimeter of the mattress system 100. The rail structure 110 can provide some shape and/or structural support to the mattress system 100. In some implementations, one or more additional foam layers can be inserted between the rail structure 110 and one or more of the chambers 102A and 106A at the head end 114 of the mattress system 100, as depicted and described further in reference to FIG. 6. The additional foam layers can be advantageous to help with positioning the chambers 102A and 106A farther away from the head end 114 of the mattress system 100. Such a configuration can be preferred by a user who is shorter in height in comparison to a taller user.

In some implementations, air chambers can be stacked inside the mattress system 100. For example, in a shoulder region of the mattress system 100, an additional, lower air chamber (e.g., refer to lower air chamber 1000A in FIG. 10A) can be stacked or positioned beneath the first air chamber 102A and fluidly connected to the first and second air chambers 102A and 102B. One or more other stacking configurations can be realized for the mattress system 100, as described further in relation to FIGS. 7A-H.

The first, second, third, and/or fourth foam inserts 104A, 104B, 108A, and 108B, respectively, can be made of foam or some similar type of cushioning material, such as synthetic support materials (e.g., polymer materials) or natural support materials. In some implementations, all the foam inserts 104A, 104B, 108A, and 108B can have a same firmness level. Any one or more of the foam inserts 104A, 104B, 108A, and 108B can also have different firmness levels, based on user preference or as otherwise suitable for the application. For example, foam inserts that are positioned around the lumbar region of the mattress system 100 can be more firm than foam inserts positioned around the foot region of the mattress system 100. Any one or more of the foam inserts 104A, 104B, 108A, and/or 108B can also include a rectangular open cell foam cushion. Such a foam cushion can, for example, be positioned between the first and second air chambers 102A and 102B and/or the third and fourth air chambers 106A and 106B at a location exterior to both sets of chambers 102A and 102B and 106A and 106B. As depicted throughout the disclosure, the foam inserts 104A, 104B, 108A, and 108B can be positioned between the first and second air chambers 102A and 102B and the third and fourth air chambers 106A and 106B, respectively, so as to physically separate the first air chamber 102A from the second air chamber 102B longitudinally and the third air chamber 106A from the fourth air chamber 106B longitudinally. One or more of the foam inserts 104A, 104B, 108A, and 108B can have different or same firmness levels based on user preference.

One or more of the first, second, third, and fourth foam inserts 104A, 104B, 108A, and 108B can be insertable and moveable inside the rail structure 110. Therefore, any one or more of the foam inserts 104A, 104B, 108A, and 108B can be replaced, switched with other supports, and otherwise moved to different regions or locations within the mattress system 100 as desired by the user. In some implementations, one or more of the foam inserts 104A, 104B, 108A, and 108B can be attached to the rail structure 110. For example, one or more of the foam inserts 104A, 104B, 108A, and 108B can be attached to a rail structure 110 using laminate, glue, adhesives, buttons, snaps, hook-and-loop fasteners, and/or zippers. In some implementations, one or more of the foam inserts 104A, 104B, 108A, and 108B can removably attach to the rail structure 110 to retain it in place but also to provide customization of component arrangement within the mattress system 100.

The mattress system 100 can be sized in a number of suitable mattress sizes, including Full, Queen, and King sized beds. In some of such implementations, the mattress system 100 can include a first zone having the first air chamber 102A, the second air chamber 102B, the first foam insert 104A, and the second foam insert 104B. The mattress system 100 can also include a second zone having the third air chamber 106A, the fourth air chamber 106B, the third foam insert 108A, and the fourth foam insert 108B. The first zone can be used by a first user and the second zone can be used by a second user. In some implementations, such as with Full, Twin, or Single beds, the mattress system 100 may only include the first air chamber 102A, the second air chamber 102B, the first foam insert 104A, and the second foam insert 104B. The second air chamber 102B can be fluidly connected to the first air chamber 102A. Similarly, the fourth air chamber 106B can be fluidly connected to the third air chamber 106A in the mattress system 100 that is Full, Queen, and/or King sized. As a result, a single zone air pressure (e.g., common internal pressure) can be maintained between the first and second air chambers 102A and 102B and the third and fourth air chambers 106A and 106B, respectively. Maintaining the single zone air pressure can be advantageous to make controlling adjustability settings of the mattress system 100 easier for a user or users. Moreover, maintaining single zone air pressures can reduce manufacturing costs of the mattress system 100. For example, all air chambers can be produced in a same size having same pressure settings and adjustability features. As a result, if air chambers need to be fixed, swapped out, or otherwise replaced, maintenance costs can be lower and more affordable. Fixing any of the air chambers used in the mattress system 100 can be easier and faster.

Maintaining a single air pressure between the first and second air chambers 102A and 102B and the third and fourth air chambers 106A and 106B can further provide spine alignment and lumbar support. Therefore, when air pressure is adjusted, portions of the user's body can be aligned relatively well both before and after the pressure adjustment. As pressure is uniformly decreased from the first and second air chambers 102A and 102B, the foam inserts 104A and 104B will not deflate with the chambers 102A and 102B. Therefore, the foam inserts 104A and 104B provide continuous support to waist, and/or lower leg regions to maintain or even improve spine alignment and overall comfortability, even when the user desires to lower pressure levels of the chambers 102A and 102B in the mattress system 100. Therefore, decreasing the common internal pressure in the first and second air chambers 102A and 102B can cause the foam insert 104A positioned between the chambers 102A and 102B to maintain or even increase support at the lumbar region of the mattress system 100.

As shown in FIG. 1, the first and third air chambers 102A and 106A can be positioned at the shoulder region of the mattress system 100 and the second and fourth air chambers 102B and 106B can be positioned at the hip region of the mattress system 100. One or more other configurations can be realized based on user preference and as described throughout this disclosure. The first air chamber 102A can be positioned at a head end 114 of the mattress system 100 around a shoulder region. The first foam insert 104A can be positioned between the first air chamber 102A and the second air chamber 102B and the second foam insert 104B can be positioned between the second air chamber 102B and a foot end 116 of the mattress system 100. The third air chamber 106A, the fourth air chamber 106B, the third foam insert 108A, and the fourth foam insert 108B are similarly positioned. Any one or more of the components can also be arranged in different configurations, as described throughout this disclosure (e.g., refer to FIGS. 3-6). Furthermore, one or more of the components, such as the first, second, third, and fourth foam inserts 104A, 104B, 108A, and 108B, respectively, can be removed and/or replaced based on user preference. In some implementations, one or more additional foam inserts can be positioned between at least one of the first air chamber 102A and the head end 114 of the mattress system 100, the first air chamber 102A and the second air chamber 102B, and the second air chamber 102B and the foot end 116 of the mattress system 100 (e.g., refer to FIGS. 3-6).

Moreover, as depicted, the components of the mattress system 100 are arranged inside a perimeter formed by the rail structure 110. The rail structure 110 can be a foam structure (or other material suitable for the application) that can maintain the components described herein in place when the mattress system 100 is moved and used. The rail structure 110 can therefore be positioned around a perimeter of the mattress system 100.

The mattress can also include a mattress cover 112. The mattress cover 112 can cover the components described herein to also maintain the components in place. The mattress cover 112 can be made of one or more fabrics or other similar textile materials. The mattress cover 112 can enclose the entire mattress system 100. The mattress cover 112 can also contain one or more foam layers (not shown in FIG. 1) that can be positioned on top of each of the first, second, third, and fourth air chambers 102A, 102B, 106A, and 106B, respectively, as well as the first, second, third, and fourth foam inserts 104A, 104B, 108A, and 108B, respectively.

Figure 8:
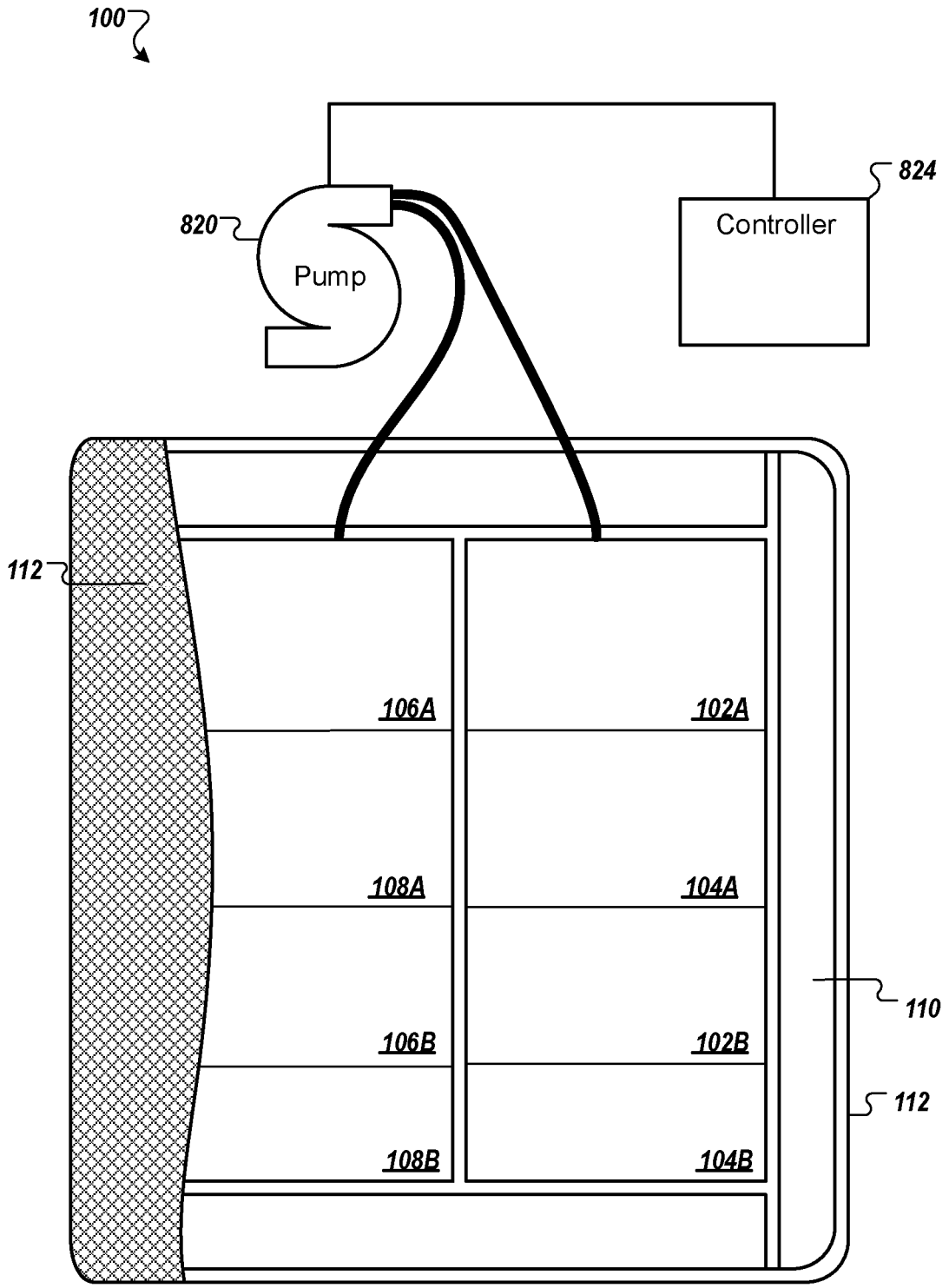
FIG. 8 depicts the example mattress system with a pump.
Figure 9:
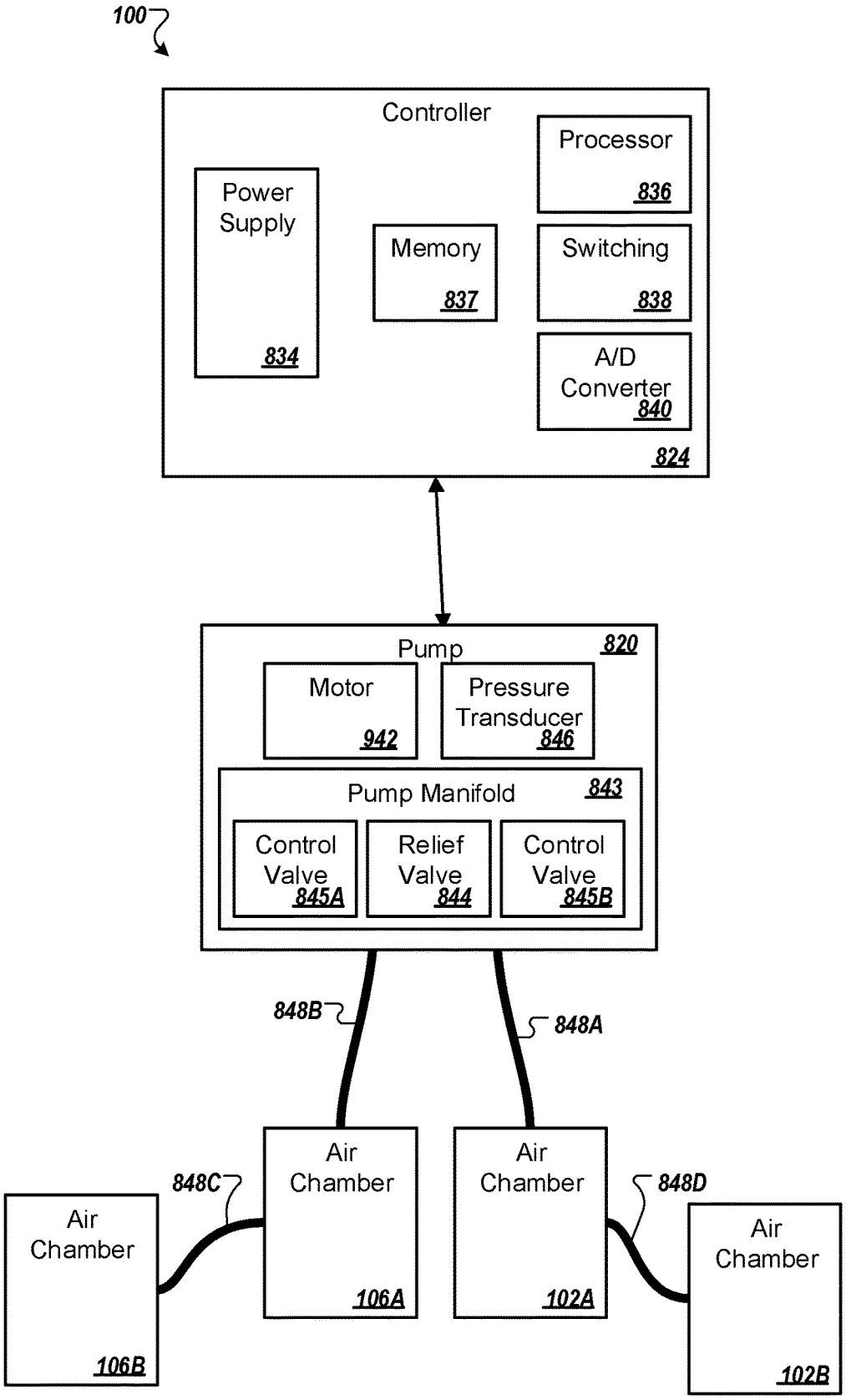
FIG. 9 is a block diagram of an example of various components of the mattress system with the pump.

As depicted in FIGS. 8-9, the mattress system 100 can be in fluid communication (via hoses) to a pump 720. The pump 720 can include one or more air pumps that can be fluidly connected to the first, second, third, and fourth air chambers 102A, 102B, 106A, and 106B, respectively. The pump 720 can be configured to inflate the first and second air chambers 102A and 102B to a first common internal pressure. The pump 720 can also be configured to inflate the third and fourth air chambers 106A and 106B to a second common internal pressure. The first common internal pressure can be different than the second common internal pressure, for example, based on user preference.

Figure 2:
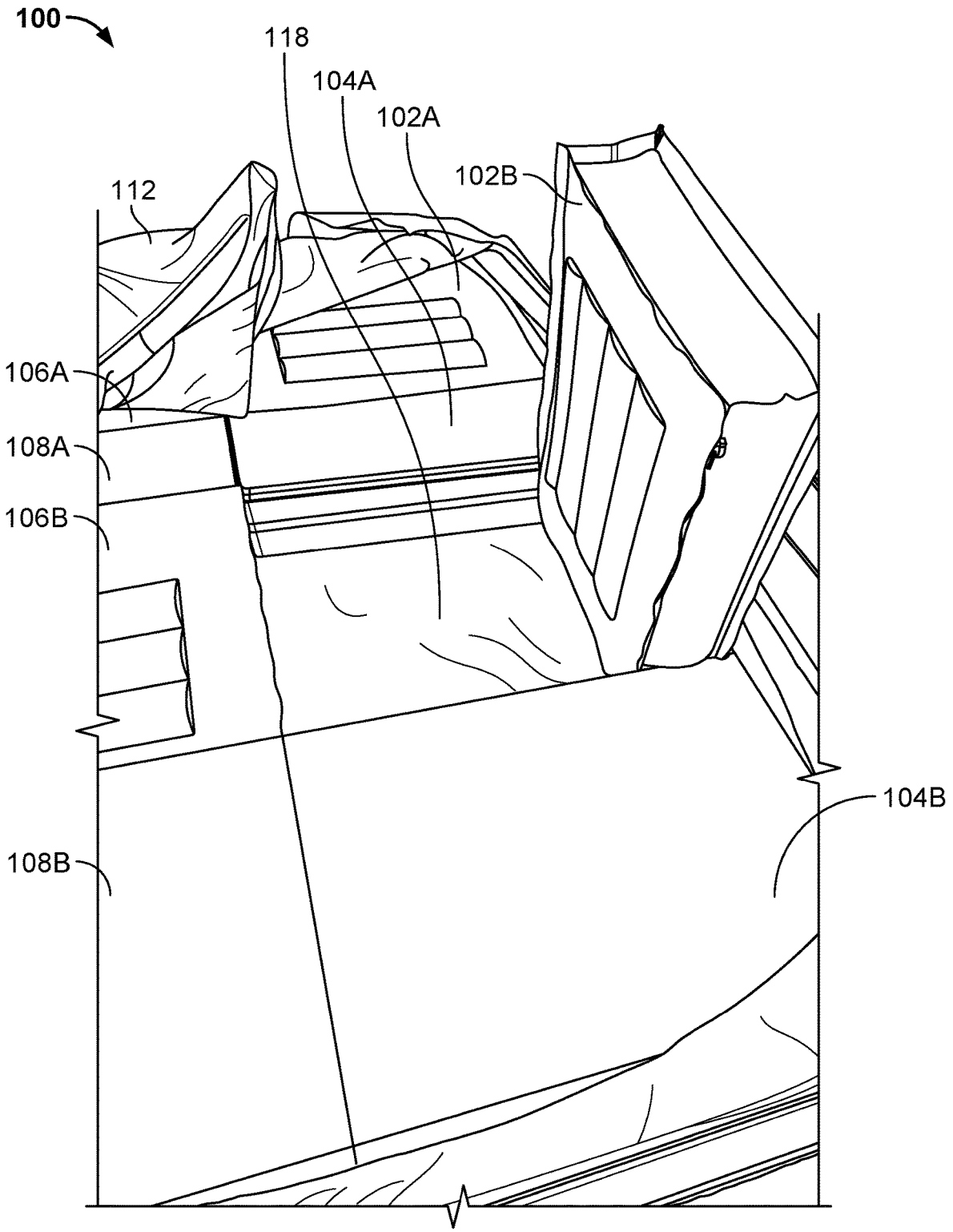
FIG. 2 depicts components of the mattress system described herein.

FIG. 2 depicts the mattress system 100 positioned upside down with a bottom portion of the cover 112 open to show various internal components of the mattress system 100. The mattress system 100 can include a layer 118 positioned between a top surface of the mattress system 100 and each of the first, second, third, and fourth air chambers 102A, 102B, 106A, and 106B as well as the rail structure 110, and the first, second, third, and fourth foam inserts 104A, 104B, 108A, and 108B. The layer 118 can be made of foam or another similar material or cushion. For example, the layer 118 can be formed of one or more viscoelastic foam materials or other materials suitable for the application. The layer 118 can provide comfort to the user when sleeping in the mattress system 100. In some embodiments, the layer 118 can be adhered or otherwise attached to the rail structure 110 to form somewhat of a foam tub. The foam tub (formed by a combination of the layer 118 and the rail structure 110) is, effectively, an upside-down foam tub when the mattress system 100 is flipped right-side-up.

Figure 3:
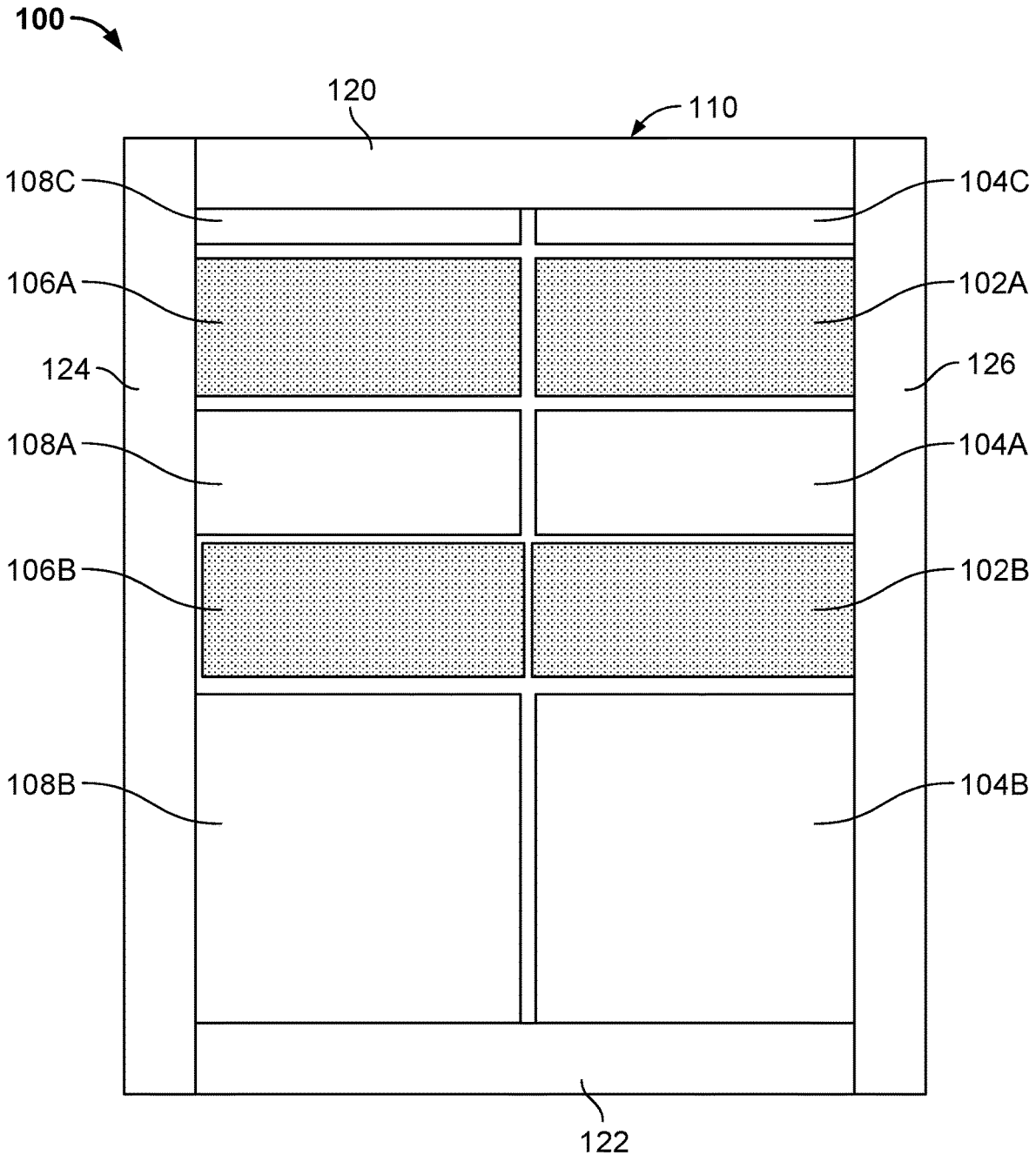
FIG. 3 is an example configuration of components of the mattress system.
Figure 4:
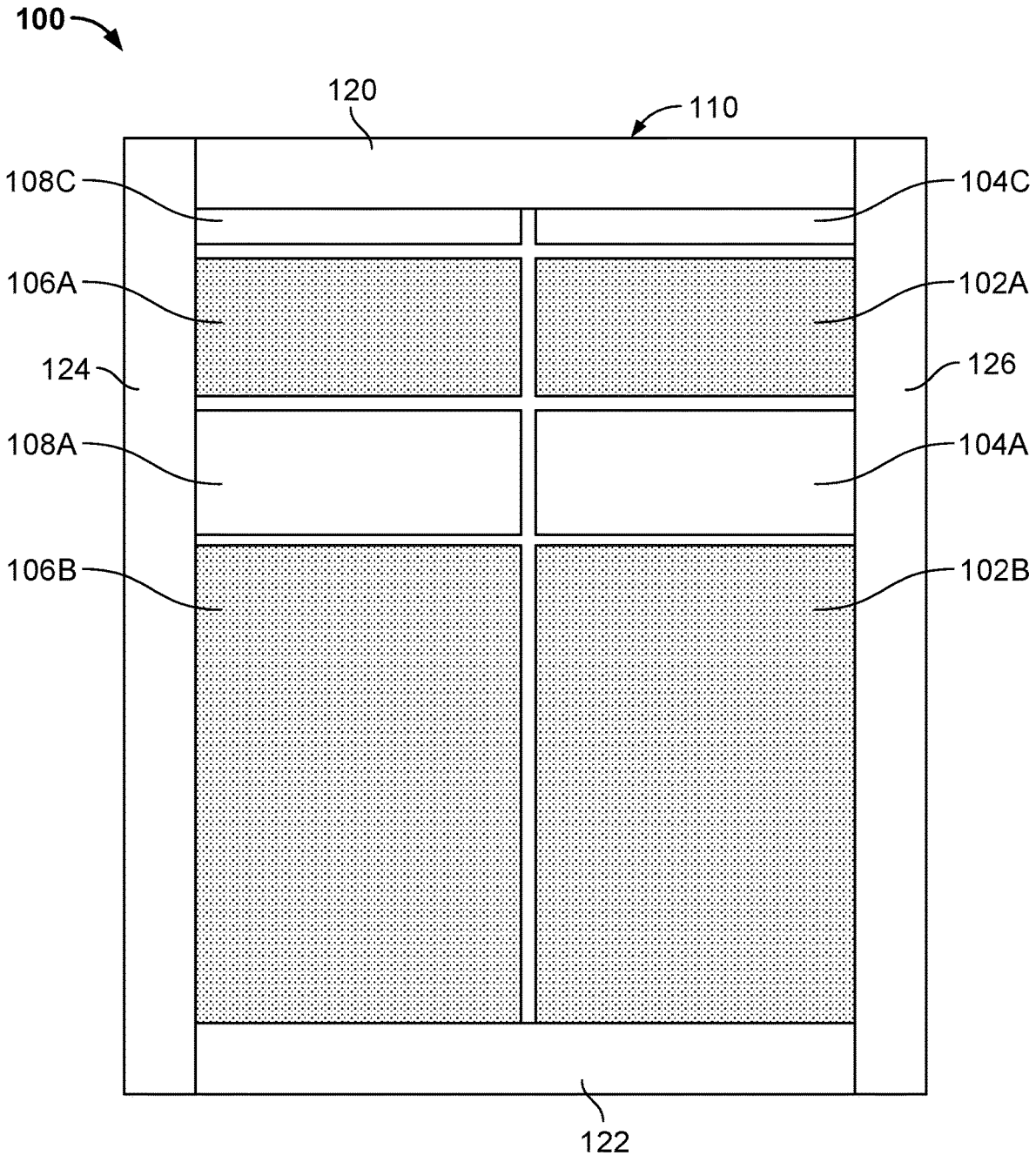
FIG. 4 is another example configuration of components of the mattress system.
Figure 5:
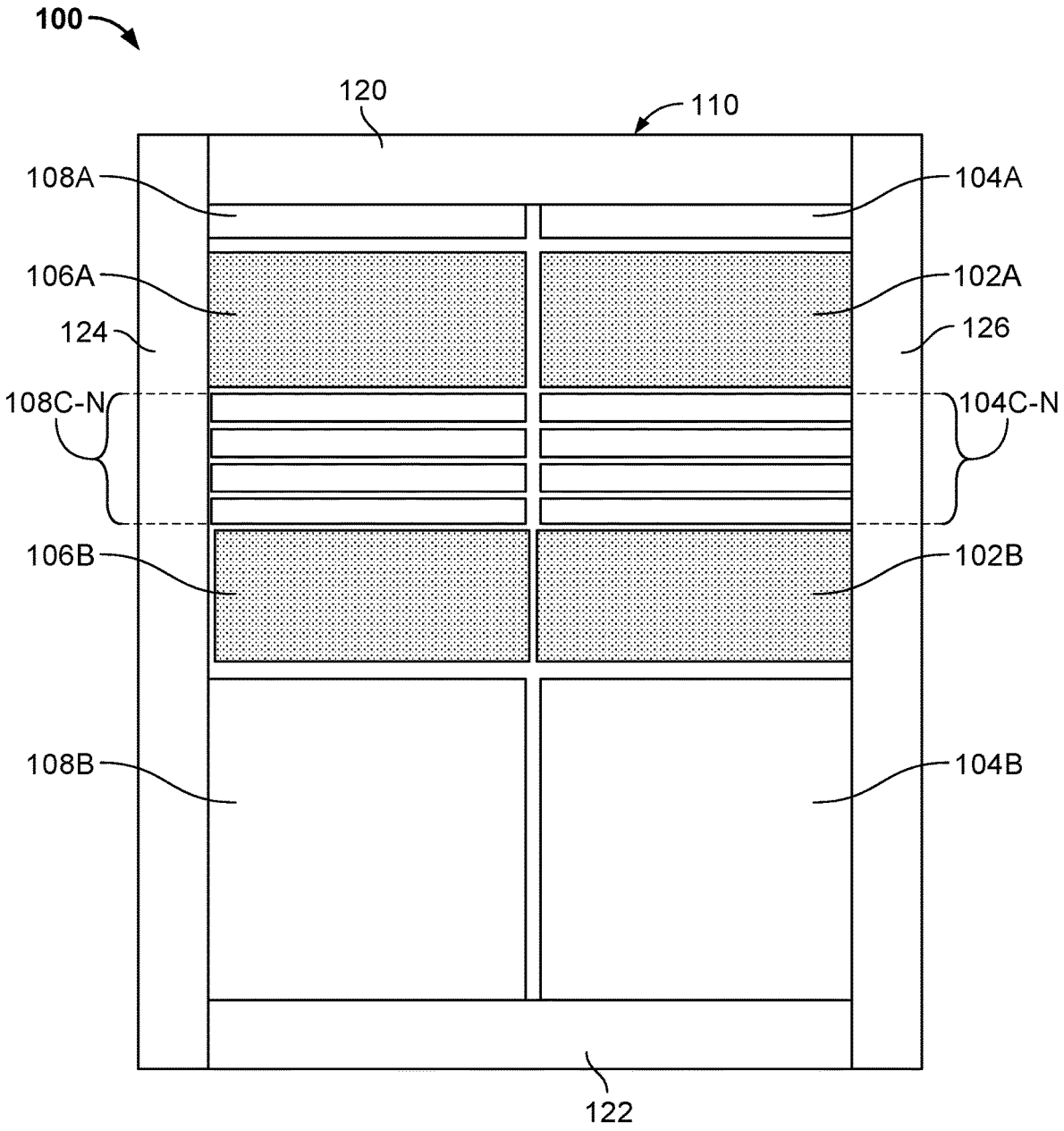
FIG. 5 is another example configuration of components of the mattress system.
Figure 6:
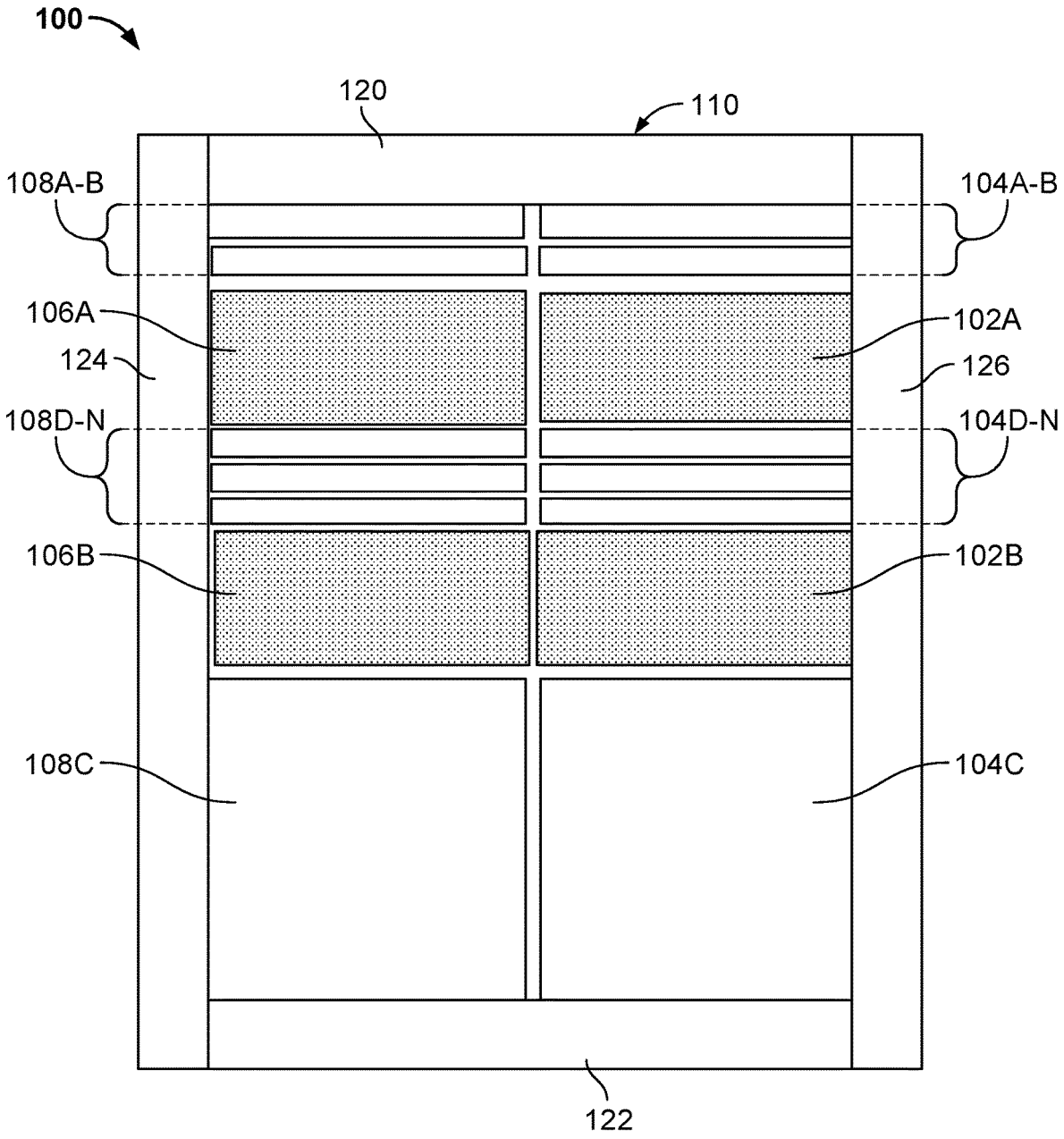
FIG. 6 is another example configuration of components of the mattress system.

FIG. 3 is an example configuration of components of the mattress system 100. FIGS. 4, 5, and 6 are additional example configurations of components of the mattress system 100. The FIGS. 3-6 depict different air chamber and/or foam insert orientations and placements within the mattress 100. As shown in the FIGS. 3-6, the foam inserts can be interchangeable, removed, and/or replaced with other types and/or sizes of foam inserts. One or more users of the mattress system 100 can customize positioning of the components depicted and described throughout this disclosure. For example, a tall user can prefer to position the second air chamber 102B closer to a foot end of the mattress 100 to accommodate for their height. A shorter user can prefer to position the first and second air chambers 102A and 102B closer together to accommodate for their height. As another example, a user can prefer to position multiple firmer foam inserts between the first and second air chambers 102A and 102B to provide more support to their lumbar region.

The air chambers 102A, 102B, 106A, and 106B can be the same size (or substantially the same size) as each other. This can be advantageous for simplicity and also lower cost for manufacturing, repair, and/or replacement, as well as for maintaining all portions of the body balanced and aligned while the pressure settings of the mattress system 100 change. In some implementations, as shown in FIG. 4, one or more of the air chambers 102A, 102B, 106A, and 106B can be different sizes. For example, the second and fourth air chambers 102B and 106B can be longer than the first and third air chambers 102A and 106A (e.g., refer to FIG. 4). In some implementations, the first and second air chambers 102A and 102B can be first sizes and the third and fourth air chambers 104A and 104B can be second sizes, based on user preference. The first and second sizes can be different.

Referring to the FIGS. 3-6, the rail structure 110 can include a head portion 120, a foot portion 122, and first and second side portions 124 and 126. The rail structure 110 can extend around a perimeter of the mattress system 100 to surround the first, second, third, and fourth air chambers 102A, 102B, 106A, and 106B, respectively, as well as the foam inserts as described herein (e.g., foam inserts 104A-C and 108A-C in FIG. 3; 104A, 104C, 108A, and 108C in FIG. 4; 104A-N and 108A-N in FIGS. 5-6). In some implementations, as shown in FIG. 4, the second and fourth air chambers 102B and 106B can extend from a hip region of the mattress system 100 to a location adjacent to an inner surface of the foot portion 122 of the foam rail structure 110. Similarly, the first air chamber 102A can extend from a location adjacent to an inner surface of the head portion 120 of the foam rail structure to a shoulder region of the mattress system 100.

In some implementations, such as where the mattress system 100 has only the first and second air chambers 102A and 102B, the first air chamber 102A can be positioned at the shoulder region of the mattress system 100 and extend laterally between locations adjacent to inner surfaces of the first and second side portions 124 and 126 of the rail structure 110. The second air chamber 102B can be positioned at the hip region of the mattress system 100 and extend laterally between the locations adjacent to the inner surfaces of the first and second side portions 124 and 126 of the rail structure 110.

As depicted in FIGS. 3-6, one or more foam inserts can be positioned between the first and third air chambers 102A and 106A and a location adjacent to an inner surface of the head portion 120 of the rail structure 110 and extend laterally between locations adjacent to inner surfaces of the first and second side portions 124 and 126 of the rail structure 110 and a midline of the mattress system 100. As depicted in FIGS. 3, 5, and 6, one or more foam inserts can be positioned between the second and fourth air chambers 104B and 108B at a location adjacent to an inner surface of the foot portion 122 of the rail structure 110 and extend laterally between the locations adjacent to the inner surfaces of the first and second side portions 124 and 126 of the rail structure 110 and the midline of the mattress system 100.

FIG. 3 depicts a configuration in which foam inserts 104C and 108C are positioned between the head portion 120 of the rail structure 110 and the first and third air chambers 102A and 106A, respectively. Foam inserts 104A and 108A can be positioned between the first and third air chambers 102A and 106A and the second and fourth air chambers 102B and 106B, respectively. Foam inserts 104B and 108B can be positioned between the second and fourth air chambers 102B and 106B and the foot portion 122 of the rail structure 110. In some implementations, the components 102A, 102B, 104A, 104B, and 104C can be arranged differently than the components 106A, 106B, 108A, 108B, and 108C, based on user preferences.

FIG. 4 is another example configuration of components of the mattress system 100. As shown and described throughout, the second and fourth air chambers 102B and 106B can extend from the waist region of the mattress to the foot portion 122 of the rail structure 110. Moreover, as described throughout, a first user can set up the air chambers 102A and 102B as depicted in FIG. 4 and a second user can set up the air chambers 106A and 106B as depicted in any of the other configurations described herein.

FIG. 5 is another example configuration of components of the mattress system 100. One or more users can position multiple foam inserts 104C-N and 108C-N between the first and second air chambers 102A and 102B and the third and fourth air chambers 106A and 106B, respectively. Foam inserts 104C-N and 108C-N can be relatively short to allow a user to move or remove one or more of them while leaving the others in place, thus adjusting the mattress as appropriate for a given user.

FIG. 6 is another example configuration of components of the mattress system 100. One or more users can position one or more foam inserts 104A-B and 108A-B between the head portion 120 of the rail structure 110 and the first and third air chambers 102A and 106A, respectively. One or more users can additionally or alternatively position one or more foam inserts 104D-N and 108D-N between the first and second air chambers 102A and 102B and the third and fourth air chambers 106A and 106B, respectively.

Figure 7A:
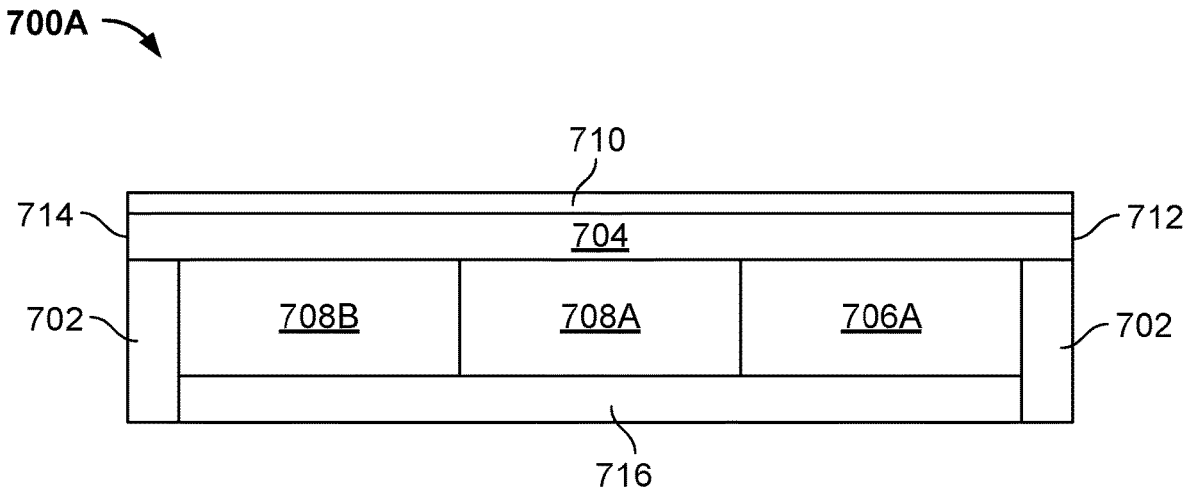
FIGS. 7A-H depict example configurations of the mattress system having stacked air chambers.

FIGS. 7A-H depict example configurations of the mattress system having stacked air chambers. FIG. 7A is a schematic side view of mattress system 700A with a cover removed to show internal components thereof. The configuration in FIG. 7A is advantageous to provide additional support and adjustment in a shoulder region of the mattress system 700A. The mattress system 700A has a head end 712 and a foot end 714. The mattress system 700A can include a top layer 710, an air chamber 704, a rail structure 702, an air chamber 706A, foam inserts 708A and 708B, and a foam base layer 716. A mattress cover (not shown in FIG. 7A) can be positioned on an outside of the mattress system 700A. The top layer 710 can extend across an entire length of the mattress system 700A from the head end 712 to the foot end 714 of the mattress system 700. The top layer 710 can be any type of material as described throughout this disclosure, such as foam, batting, or other suitable material. The top layer 710 can provide comfort and/or support to a user resting on the mattress system 700A.

The air chamber 704 can extend across some, most, or all of a length of the mattress system 700A from the head end 712 to the foot end 714 of the mattress system 700A. In the embodiment illustrated in FIG. 7A, the air chamber 704 extends substantially an entire length of the mattress system 700A except for a cover (not shown) positioned on the outside. The air chamber 706A and the foam inserts 708A and 708B can be stacked beneath the air chamber 704. For example, as depicted in FIG. 7A, the air chamber 706A can be closer to the head end 712 of the mattress system 700A to provide additional and improved adjustment in a shoulder and head region of the mattress system 700A. The foam inserts 708A and 708B can be positioned next to each other along the length of the mattress system 700A from the air chamber 706A to the foot end 714 of the mattress system 700A. The foam base layer 716 can, like the air chamber 704, extend across the entire length of the mattress system 700A from the head end 712 to the foot end 714, beneath the air chamber 704, the stacked air chamber 706A, and the foam inserts 708A and 708B.

The rail structure 702 can form a perimeter around the stacked air chamber 706A, the foam inserts 708A and 708B, and the foam base layer 716. The rail structure 702 can provide additional structural support to the mattress system 700 and maintain the stacked air chamber 706A, the foam inserts 708A and 708B, and the foam base layer 716 in place.

One or more of the components described in reference to the mattress system 700A in FIG. 7A can be similar and/or same as the components described throughout this disclosure (e.g., refer to FIG. 1). Moreover, in some implementations, the air chambers 704 and 706A can be fluidly connected to share a common pressure. This configuration is advantageous to provide increased support, spinal alignment, and adjustment in the shoulder region of the mattress system 700A. In some implementations, the air chambers 704 and 706A can have different pressures to provide for increased customization of support by the user.

In operation, pressure can be adjusted concurrently in the air chambers 704 and 706A. As pressure is increased, for example, in the air chambers 704 and 706A, the user can experience increased support and/or firmness in the shoulder region. As pressure is decreased in the air chambers 704 and 706A, the mattress 700A can provide an increasingly soft (less firm) mattress across a user's entire body because pressure decreases in air chamber 704. Further, this can allow the user's body to sink in at the shoulder region more than at the legs and hips because pressure also decreases in the air chamber 706A without substantially changing the firmness of the foam inserts 708A and 708B. Thus, reducing pressure in the air chambers 704 and 706A can allow a user to sink in more at the shoulder region than at other regions to reduce pressure while also maintaining spinal alignment of the user.

Figure 7B:
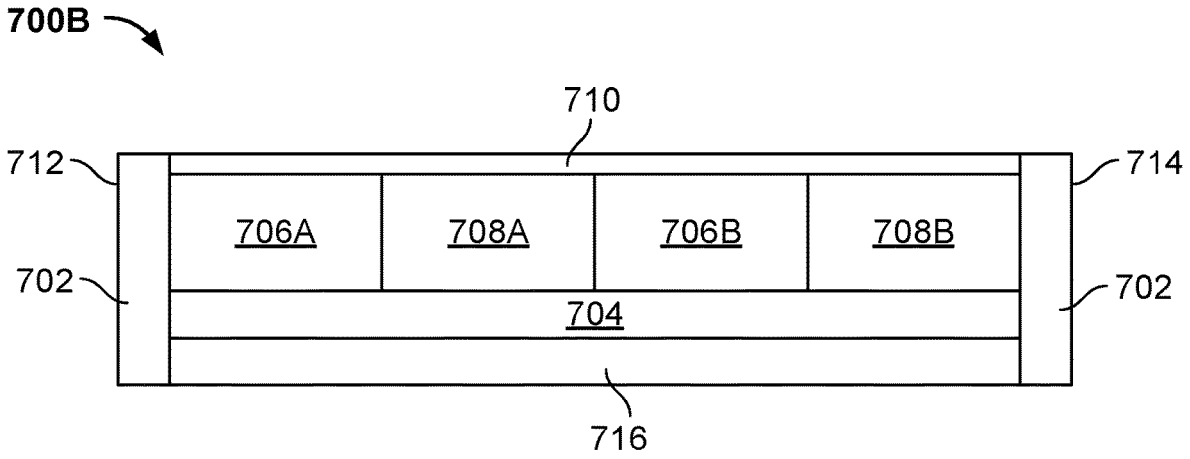

FIG. 7B is a schematic side view of mattress system 700B with a cover removed to show internal components thereof. The configuration in FIG. 7B is advantageous to provide additional support and adjustment in the shoulder region and a hip region of the mattress system 700B. The mattress system 700B can include the top layer 710, the rail structure 702, a first air chamber 706A, a second air chamber 706B, foam inserts 708A and 708B, the air chamber 704, and the foam base layer 716. A mattress cover (not shown in FIG. 7B) can be positioned on an outside of the mattress system 700B. In the illustrated embodiment, the top layer 710 extends between head and foot portions of the rail structures 702. In alternative embodiments, such as described in reference to FIG. 7A, the top layer 710 can extend across substantially the entire length of the mattress system 700B from the head end 712 to the foot end 714 of the mattress system 700B.

The first air chamber 706A can be positioned in the shoulder region of the mattress system 700B, at the head end 712 of the mattress system 700B. The foam insert 708A can be positioned between the first air chamber 706A and the second air chamber 706B. The second air chamber 706B can be positioned in the hip region of the mattress system 700B. The foam insert 708B can extend from the second air chamber 706B to the foot end of the mattress system 700B across a leg region of the mattress system 700B.

The air chamber 704 can extend across some, most, or all of a length of the mattress system 700B from the head end 712 to the foot end 714 beneath the top layer 710, the first and second air chambers 706A and 706B, and the foam inserts 708A and 708B. In the embodiment illustrated in FIG. 7B, the air chamber 704 extends substantially an entire length of the mattress system 700B, except for a cover (not shown) positioned on the outside. The foam base layer 716 can, like the air chamber 704, extend across some, most, or all of a length of the mattress system 700B from the head end 712 to the foot end 714, and be positioned beneath the air chamber 704.

The rail structure 702 can form a perimeter around the top layer 710, the first and second air chambers 706A and 706B, the foam inserts 708A and 708B, the air chamber 704, and the foam base layer 716. The rail structure 702 can provide additional structural support to the mattress system 700B and maintain the components described herein in place.

One or more of the components described in reference to the mattress system 700B in FIG. 7B can be similar and/or same as the components described throughout this disclosure (e.g., refer to FIG. 1). Moreover, in some implementations, the air chambers 704, 706A, and 706B can be fluidly connected to share a common pressure. This configuration is advantageous to provide increased support, spinal alignment, and adjustment in the shoulder and hip regions of the mattress system 700B. In some implementations, the air chambers 704, 706A, and 706B can have different pressures to provide for increased customization of support by the user.

In operation, pressure can be adjusted concurrently in the air chambers 704, 706A, and 706B. As pressure is increased, for example, the user can experience increased support and/or firmness in the shoulder and hip regions. As pressure is decreased in the air chambers 704, 706A, and 706B, the mattress 700A can provide an increasingly soft mattress across a user's entire body because pressure decreases in air chamber 704, and further, can allow the user's body to sink in at the shoulder region and hip region more than at the legs and waist because pressure also decreases in the air chamber 706A (shoulders) and the air chamber 706B (hips) without substantially changing the firmness of the foam inserts 708A (legs) and 708B (waist). Thus, reducing pressure in the air chambers 704, 706A, and 706B can allow a user to sink in more at the shoulder and hips regions than at other regions to reduce pressure while also maintaining spinal alignment of the user.

Figure 7C:
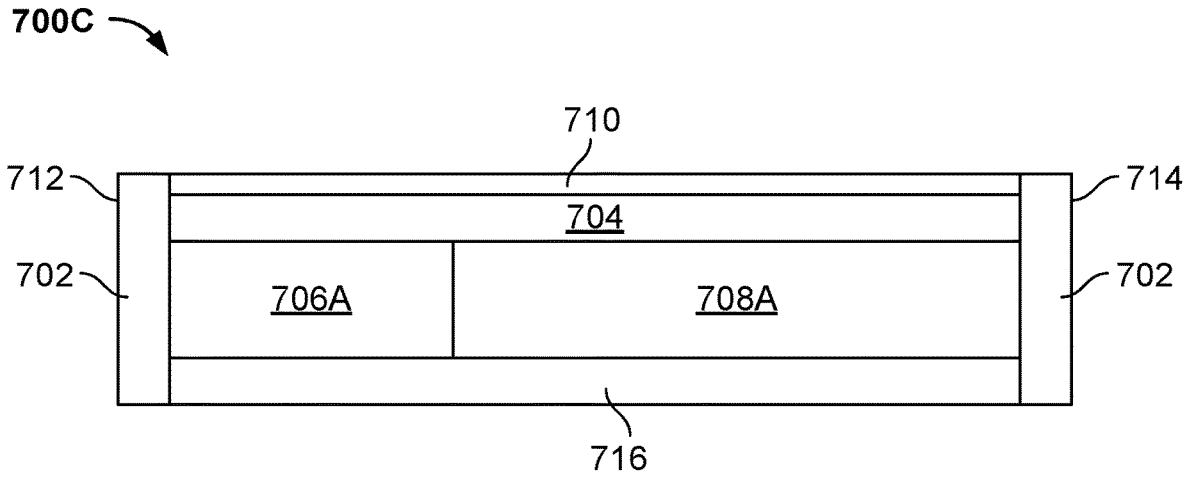

FIG. 7C is a schematic side view of mattress system 700C with a cover removed to show internal components thereof. The mattress system 700C is advantageous because it enables more direct firmness adjustments to be made for all regions of a sleeper's body while still focusing a largest amount of adjustment in a region where air chambers are stacked. Thus, the mattress system 700C can maintain and improve spinal alignment as well as comfortability for the entire body of the sleeper. The configuration in FIG. 7C is also advantageous to provide additional support and adjustment in the shoulder region of the mattress system 700C and to reduce a number of components used in the mattress system 700C. Fewer components can make maintenance of the mattress system 700C easier, faster, and less costly. Fewer components can also make it easier for the user to replace or otherwise swap out one or more of the components.

Referring to the mattress system 700C in FIG. 7C, the mattress system 700C can include the top layer 710, the rail structure 702, the air chamber 704, the air chamber 706A, the foam insert 708A, and the foam base layer 716. In the illustrated embodiment, the top layer 710 extends between head and foot portions of the rail structures 702. In alternative embodiments, such as described in reference to FIG. 7A, the top layer 710 can extend across substantially the entire length of the mattress system 700C from the head end 712 to the foot end 714 of the mattress system 700. The air chamber 704 can extend beneath the top layer 710 across some, most, or all of a length of the mattress system 700C from the head end 712 to the foot end 714 of the mattress system 700C. The air chamber 706A can be positioned in the shoulder region of the mattress system 700C, at the head end 712 of the mattress system 700C. The foam insert 708A can be positioned next to the air chamber 706A and can extend from the air chamber 706A to the foot end 714 of the mattress system 700. In this configuration, only one foam insert is used in the mattress system 700C. This can be advantageous for the reasons mentioned above. The foam base layer 716 can, like the air chamber 704, extend across some, most, or all of a length of the mattress system 700C from the head end 712 to the foot end 714, and be positioned beneath the top layer 710, the air chamber 704, the stacked air chamber 706A, and the foam insert 708A.

The rail structure 702 can form a perimeter around the top layer 710, the air chamber 704, the stacked air chamber 706A, the foam insert 708A, and the foam base layer 716. The rail structure 702 can provide additional structural support to the mattress system 700 and maintain the components described herein in place.

One or more of the components described in reference to the mattress system 700C in FIG. 7C can be similar and/or same as the components described throughout this disclosure (e.g., refer to FIG. 1). Moreover, in some implementations, the air chambers 704 and 706A can be fluidly connected to share a common pressure. This configuration is advantageous to provide increased support, spinal alignment, and adjustment in the shoulder region of the mattress system 700C. In some implementations, the air chambers 704 and 706A can have different pressures to provide for increased customization of support by the user.

In operation, pressure can be adjusted concurrently in the air chambers 704 and 706A. As pressure is increased, for example, in the air chambers 704 and 706A, the user can experience increased support and/or firmness. As pressure is decreased in the air chambers 704 and 706A, the mattress 700A can provide an increasingly soft (less firm) mattress across a user's entire body because pressure decreases in air chamber 704, and further, can allow the user's body to sink in at the shoulder region more than at the legs and hips because pressure also decreases in the air chamber 706A without substantially changing the firmness of the foam insert 708A. Thus, reducing pressure in the air chambers 704 and 706A can allow a user to sink in more at the shoulder region than at other regions to reduce pressure while also maintaining spinal alignment of the user.

Figure 7D:
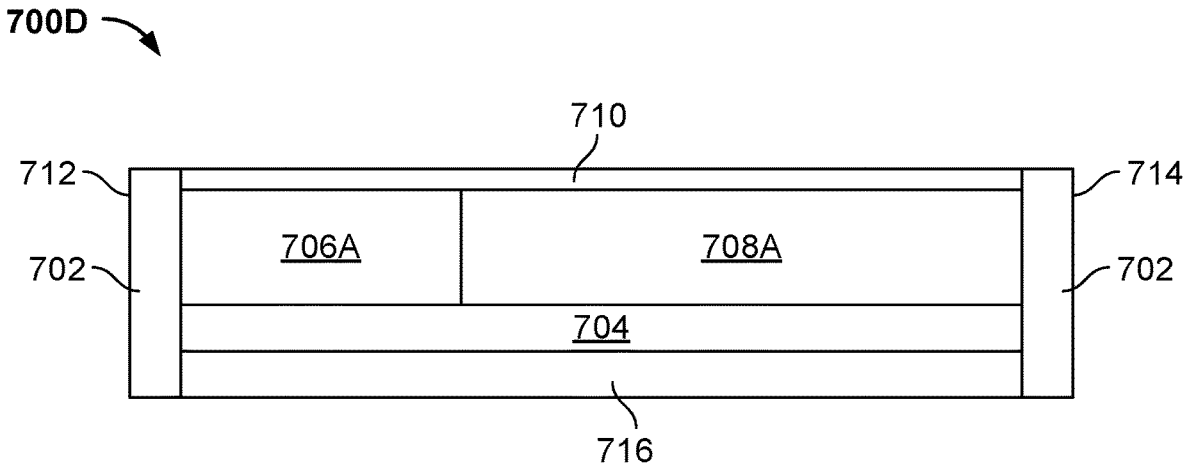

FIG. 7D is a schematic side view of mattress system 700D with a cover removed to show internal components thereof. The mattress system 700D is similar to the mattress system 700C of FIG. 7C, except that the air chamber 704 is positioned below the air chamber 706A and the foam insert 708A in the mattress system 700D, and the air chamber 704 is positioned above the air chamber 706A and the foam insert 708A in the mattress system 700C. Accordingly, the mattress system 700D can function similarly to the mattress system 700C in many ways, as described above. In some embodiments, the mattress system 700D differs from the mattress system 700C in that the mattress system 700D can provide more focus on adjusting a shoulder region of the mattress system 700D rather than adjusting regions for all regions of the body.

Figure 7E:
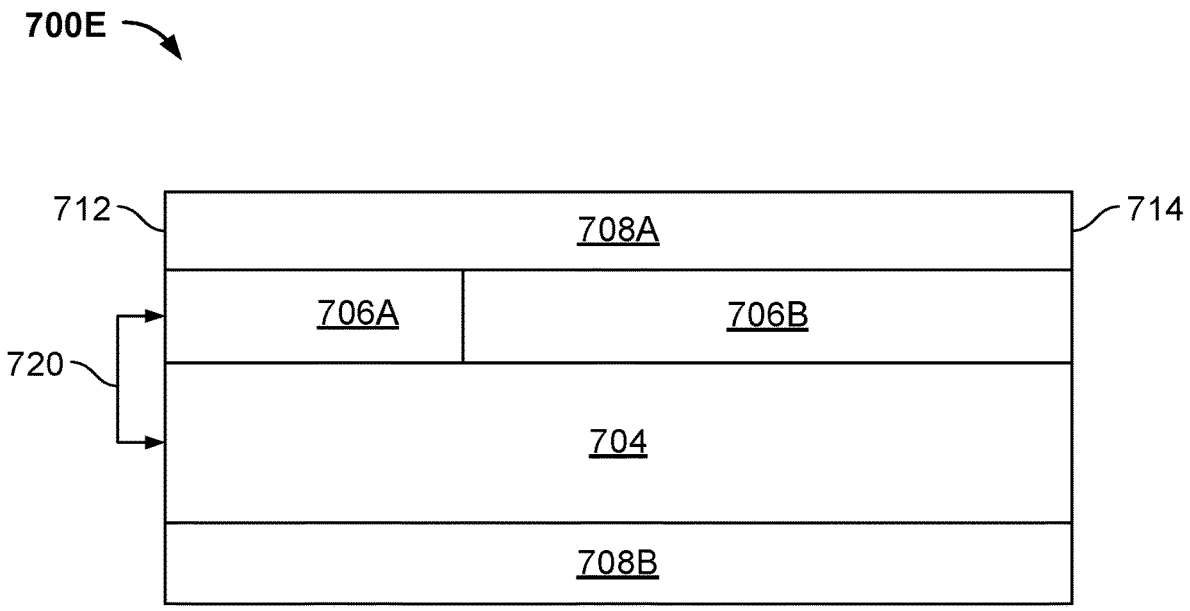

FIG. 7E is a schematic side view of mattress system 700E with a cover removed to show internal components thereof. The configuration in FIG. 7E is advantageous to provide additional and customizable support and adjustment across the entire length of the mattress system 700E. Referring to the mattress system 700E in FIG. 7E, the mattress system 700E can include the foam insert 708A, the first air chamber 706A, the second air chamber 706B, the air chamber 704, and the foam insert 708B. The foam insert 708A can extend across some, most, or all of a length of the mattress system 700E from the head end 712 to the foot end 714, similar to the top layer 710 described in FIGS. 7A-D.

The first and second air chambers 706A and 706B can be positioned beneath the foam insert 708A. The first air chamber 706A can be positioned in the shoulder region of the mattress system 700 and can extend to the head end 712 of the mattress system 700E. The second air chamber 706B can extend from the first air chamber 706A to the foot end 714 of the mattress system 700E. The second air chamber 706B can therefore be positioned in the lumbar/hip/waist/leg region of the mattress system 700E.

The air chamber 704 can be stacked beneath the foam insert 708A and the first and second air chambers 706A and 706B, and can extend across some, most, or all of a length of the mattress system 700E, from the head end 712 to the foot end 714. In the example of FIG. 7E, the air chamber 704 extends substantially an entire length of the mattress system 700E. Moreover, the air chamber 704 is taller in height than the first and second air chambers 706A and 706B. In some implementations, the air chambers 704, 706A, and 706B can have a same or similar height. In yet other implementations, the first and second air chambers 706A and 706B can be taller in height than the air chamber 704. A taller height of the first air chamber 706A can be advantageous to enable more directed spinal alignment focus. The foam insert 708B can be positioned and stacked beneath the air chamber 704, and can extend across some, most, or all of a length of the mattress system 700E, from the head end 712 to the foot end 714, like the air chamber 704. The foam insert 708B can be similar to the foam base layer 716 described in reference to FIGS. 7A-D.

In the example configuration of FIG. 7E, the first air chamber 706A and the stacked air chamber 704 are in fluid communication 720. Therefore, the first air chamber 706A and the stacked air chamber 704 can share a common pressure and can be adjusted together to improve and increase support in the shoulder region of the mattress system 700E. The second air chamber 706B may not be fluidly connected to the first air chamber 706A or the stacked air chamber 704. The second air chamber 706B can have a different adjustable pressure setting than the first air chamber 706A and the stacked air chamber 704. In some implementations, the second air chamber 706B can be fluidly connected to the stacked air chamber 704 and the first air chamber 706A may not be fluidly connected to either.

In other implementations, the first and second air chambers 706A and 706B can be fluidly connected to each other but not to the stacked air chamber 704. In other implementations, the first and second air chambers 706A and 706B can both be fluidly connected to the stacked air chamber 704.

One or more of the components described in reference to the mattress system 700E in FIG. 7E can be similar and/or same as the components described throughout this disclosure (e.g., refer to FIG. 1).

In operation, pressure can be adjusted concurrently in the air chambers 704 and 706A. Pressure can be separately adjusted in the second air chamber 706B. As pressure is increased, for example, in the air chambers 704 and 706A, the user can experience increased support and/or firmness. As pressure is decreased in the air chambers 704 and 706A, the mattress 700A can provide an increasingly soft (less firm) mattress across a user's entire body because pressure decreases in air chamber 704, and further, can allow the user's body to sink in at the shoulder region more than at the legs and hips because pressure also decreases in the air chamber 706A without substantially changing the firmness of the air chamber 706B. Thus, reducing pressure in the air chambers 704 and 706A can allow a user to sink in more at the shoulder region than at other regions to reduce pressure while also maintaining spinal alignment of the user. If the user desires to adjust air pressure in the air chamber 706B, firmness and/or spinal alignment can be further customized as appropriate for the user.

Figure 7F:
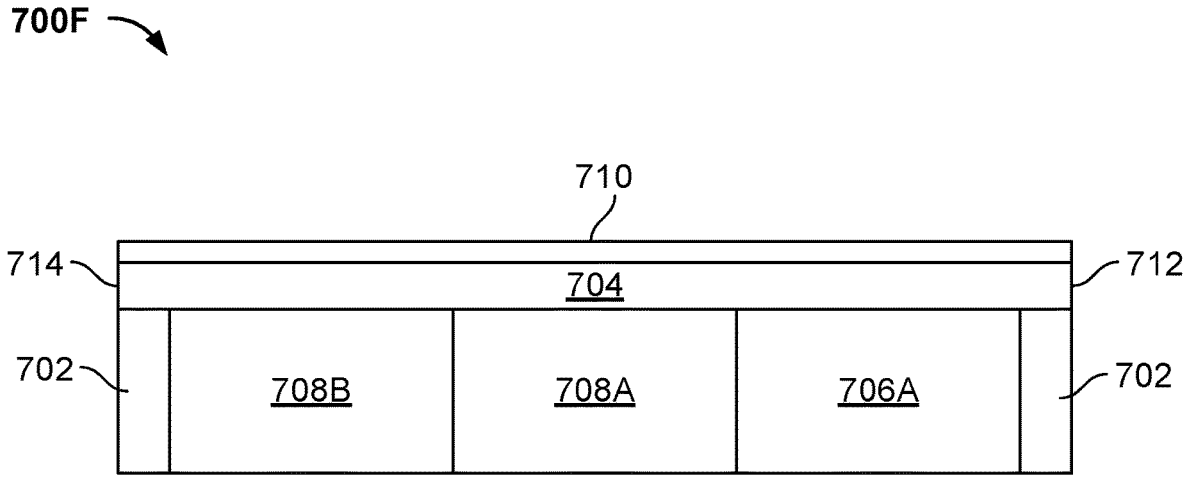

FIG. 7F is a schematic side view of mattress system 700F with a cover removed to show internal components thereof. The mattress system 700F is similar to the mattress system 700A of FIG. 7A, except that the mattress system 700F does not include the foam base layer 716 that is positioned beneath the air chamber 706A and the foam inserts 708A and 708B in the mattress system 700A. Accordingly, the mattress system 700F can function similarly to the mattress system 700A in many ways, as described above. In some embodiments, the mattress system 700F differs from the mattress system 700A in that one or more of the air chambers 704 and 706A and the foam inserts 708A and 708B can be taller in height in the mattress system 700F. Moreover, having the top layer 710 in the mattress system 700F without the foam base layer 716 can be advantageous to reduce an amount of components used in the mattress system 700F, which can make maintenance and customization of the mattress system 700F easier, faster, less costly, and more efficient.

Figure 7G:
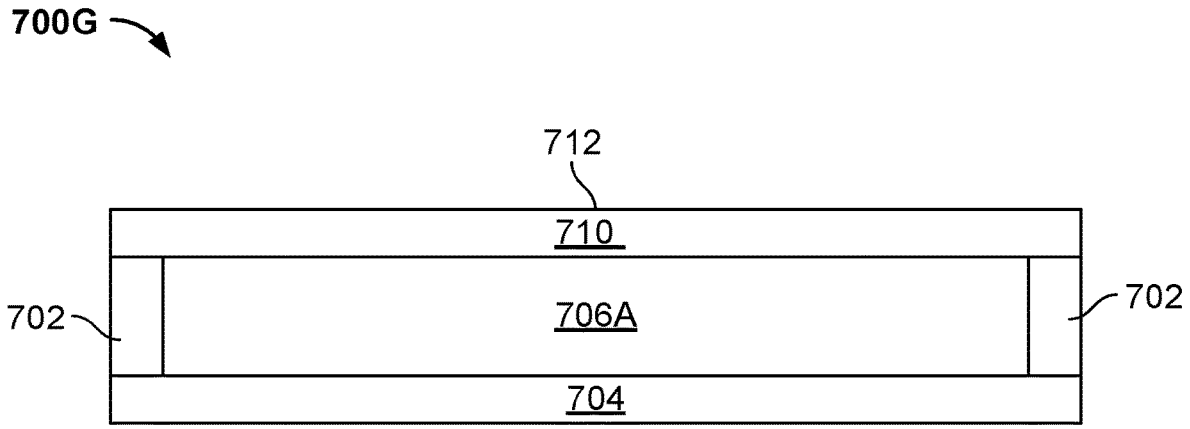

FIG. 7G is a schematic head end 712 view of an example configuration of components of mattress system 700G. As shown in this view, the mattress system 700G can include the top layer 710, the rail structure 702, the air chamber 706A, and the air chamber 704. The air chamber 704, like the top layer 710 described in reference to FIGS. 7A-D, can extend across some, most, or all of a length of the mattress system 700G. The rail structure 702 can be positioned beneath the top layer 710 and can form a perimeter around the air chamber 706A. The air chamber 706A is positioned at the head end 712 of the mattress system 700G. Although not depicted in the cross sectional head end 712 view of the mattress system 700G, an additional air chamber and/or foam inserts can extend from the air chamber 706A towards the foot end of the mattress system 700G, as depicted in reference to FIGS. 7A-F.

The air chamber 704 can be stacked beneath the top layer 710, the rail structure 702, and the air chamber 706A. The stacked air chamber 704 can extend across some, most, or all of the mattress system 700G, as described herein.

The configuration in FIG. 7G can be advantageous to control a height of the rail structure 702 as well as an impact of the rail structure 702's height with varying pressure (e.g., firmness) settings that can be applied to the air chambers 704 and 706A. One or more of the components described in reference to the mattress system 700G in FIG. 7G can be similar and/or same as the components described throughout this disclosure (e.g., refer to FIG. 1). Moreover, in some implementations, the air chambers 704 and 706A can be fluidly connected to share a common pressure. This configuration is advantageous to provide increased support, spinal alignment, and adjustment in the shoulder region of the mattress system 700G. In some implementations, the air chambers 704 and 706A can have different pressures to provide for increased customization of support by the user.

Figure 7H:
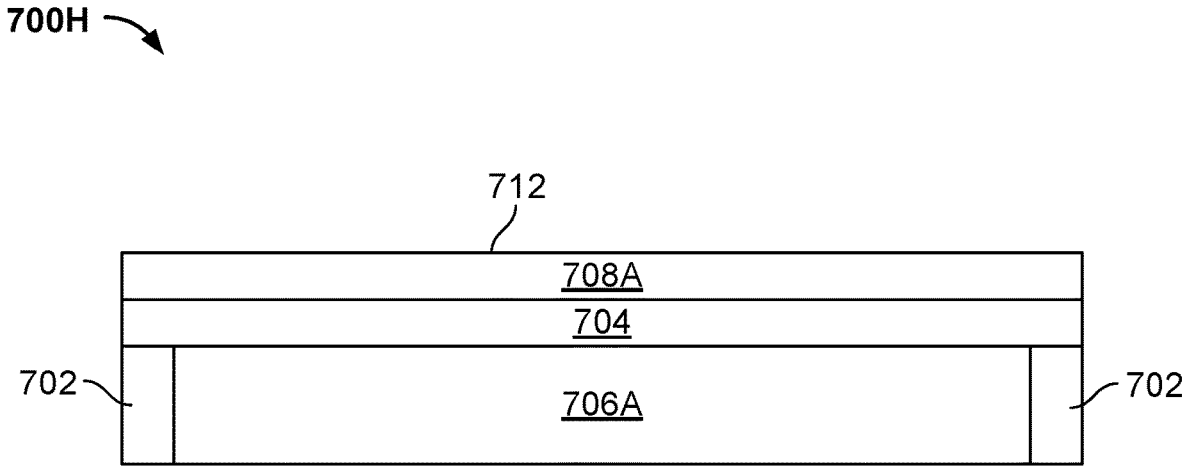

FIG. 7H is a schematic head end view 712 of an example configuration of components of mattress system 700H. As shown in this view, the mattress system 700H can include the foam insert 708A, the air chamber 704, the rail structure 702, and the air chamber 706A. The foam insert 708A, like the top layer 710 described in reference to FIGS. 7A-D, can extend across some, most, or all of a length of the mattress system 700H. The air chamber 704 can be positioned beneath the foam insert 708A and can extend across some, most, or all of a length of the mattress system 700H, as described herein. The rail structure 702 can be positioned beneath the foam insert 708A and the air chamber 704. The rail structure 702 can form a perimeter around the air chamber 706A. The air chamber 706A is positioned at the head end 712 of the mattress system 700H and stacked beneath the air chamber 704. Although not depicted in the cross sectional head end 712 view of the mattress system 700H, an additional air chamber and/or foam inserts can extend from the air chamber 706A towards the foot end of the mattress system 700H, as depicted in reference to FIGS. 7A-F.

The configuration in FIG. 7H can be advantageous to control a height of the rail structure 702 as well as an impact of the rail structure 702's height with varying pressure (e.g., firmness) settings that can be applied to the air chambers 704 and 706A. Moreover, one or more of the components described in reference to the mattress system 700H in FIG. 7H can be similar and/or same as the components described throughout this disclosure (e.g., refer to FIG. 1). Moreover, in some implementations, the air chambers 704 and 706A can be fluidly connected to share a common pressure. This configuration is advantageous to provide increased support, spinal alignment, and adjustment in the shoulder region of the mattress system 700H. In some implementations, the air chambers 704 and 706A can have different pressures to provide for increased customization of support by the user.

It can be realized that a user can customize their mattress system using any of the configurations depicted in FIGS. 7A-H. After all, as described throughout this disclosure, the components of the mattress system 700 can be moved around and/or replaced or swapped with other components to increase customization and conform to user preferences. Therefore, the user can replace a single foam insert with multiple foam inserts, move a first air chamber closer to a lumbar region of the mattress system instead of a shoulder region, change an order for stacking components, and/or make any other changes to the configuration of the mattress system 700 as the user desires.

FIG. 8 depicts the example mattress system 100 with a pump 820 and a controller 824. The controller 824 can be configured to operate the pump 820 to cause increases and decreases in fluid pressure of the first air chamber 102A, the second air chamber 102B, the third air chamber 106A, and the fourth air chamber 106B. In some implementations, the controller 824 is integrated into a housing of the pump 820.

FIG. 9 is a block diagram of an example of various components of the mattress system 100 with the pump 920. As shown in FIG. 9, the controller 824 can include a power supply 834, one or more processors 836, memory 837, a switching mechanism 838, and an analog to digital (A/D) converter 840. The switching mechanism 838 can be, for example, a relay or a solid state switch. In some implementations, the switching mechanism 838 can be located in the pump 820 rather than the controller 824. The controller 824 can be in wired or wireless communication with the pump 820.

The pump 820 can include a motor 942, a pump manifold 843, a relief valve 844, a first control valve 845A, a second control valve 845B, and one or more pressure transducers 846. The pump 820 is fluidly connected with the first air chamber 102A via a first tube 848A and the third air chamber 106A via a second tube 848B. The first air chamber 102A can then be fluidly connected with the second air chamber 102B via a third tube 848D. The third air chamber 106A can be fluidly connected with the fourth air chamber 106B via a fourth tube 848C. The first and second control valves 845A and 845B can be controlled by the switching mechanism 838, and are operable to regulate the flow of fluid between the pump 820 and the first air chamber 102A and also between the pump 820 the third air chamber 106A. The tube 848D can fluidly connect the air chamber 102A to the air chamber 102B so that the pressure in the air chamber 102B is the same or substantially the same as the air pressure in the air chamber 102A. Accordingly, the pump 820 can adjust air pressure in air chambers 102A and 102B at substantially the same time to substantially the same pressure. The tube 848C can fluidly connect the air chamber 106A to the air chamber 106B so that the pressure in the air chamber 106B is the same or substantially the same as the air pressure in the air chamber 106A. Accordingly, the pump 820 can adjust air pressure in air chambers 106A and 106B at substantially the same time to substantially the same pressure.

In some implementations, the pump 820 and the controller 824 can be provided and packaged as a single unit. In some alternative implementations, the pump 820 and the controller 824 can be provided as physically separate units. In some implementations, the controller 824, the pump 820, or both are integrated within or otherwise contained within a bed frame or bed support structure that supports the mattress system 100. In some implementations, the controller 824, the pump 820, or both are located outside of a bed frame or bed support structure.

In some implementations, a separate pump can be associated with each air chamber of the air bed system or a pump can be associated with multiple chambers of the air bed system. Separate pumps can allow each air chamber to be inflated or deflated independently and simultaneously. Furthermore, additional pressure transducers can also be incorporated into the air bed system such that, for example, a separate pressure transducer can be associated with each air chamber.

In use, the processor 836 can, for example, send a decrease pressure command to one of the air chambers 102A and 102B and/or 106A and 106B, and the switching mechanism 838 can be used to convert the low voltage command signals sent by the processor 836 to higher operating voltages sufficient to operate the relief valve 844 of the pump 820 and open the control valve 845A or 845B. Opening the relief valve 844 can allow air to escape from the air chambers 102A and 102B via the respective air tubes 848A and 848D. Opening the relief valve 844 can also allow air to escape from the air chambers 106A and 106B via the respective air tubes 848B and 848C. During deflation, the pressure transducer 846 can send pressure readings to the processor 836 via the A/D converter 840. The A/D converter 840 can receive analog information from pressure transducer 846 and can convert the analog information to digital information useable by the processor 836.

As another example, the processor 836 can send an increase pressure command. The pump motor 942 can be energized in response to the increase pressure command and send air to the designated air chambers 102A and 102B and/or 106A and 106B through the respective tubes 848A and 848D and/or 848B and 848C via electronically operating the corresponding valve 845B or 845A. While air is being delivered to the designated air chambers 102A and 102B and/or 106A and 106B to increase the firmness of the chambers, the pressure transducer 846 can sense pressure within the pump manifold 843. Again, the pressure transducer 846 can send pressure readings to the processor 836 via the A/D converter 840. The processor 836 can use the information received from the A/D converter 840 to determine the difference between the actual pressure in the air chambers 102A and 102B and/or 106A and 106B and the desired pressure.

Generally speaking, during an inflation or deflation process, the pressure sensed within the pump manifold 843 can provide an approximation of the pressure within the respective air chamber that is in fluid communication with the pump manifold 843. An example method of obtaining a pump manifold pressure reading that is substantially equivalent to the actual pressure within an air chamber includes turning off pump 820, allowing the pressure within the air chambers 102A and 102B and/or 106A and 106B and the pump manifold 843 to equalize, and then sensing the pressure within the pump manifold 843 with the pressure transducer 846. Thus, providing a sufficient amount of time to allow the pressures within the pump manifold 843 and air chambers 102A and 102B and/or 106A and 106B to equalize can result in pressure readings that are accurate approximations of the actual pressure within air chambers 102A and 102B and/or 106A and 106B. In some implementations, the pressure of the air chambers 102A and 102B and/or 106A and 106B can be continuously monitored using one or more pressure sensors. In some implementations, the pressure of the air chambers 102A and 102B and/or 106A and 106B can be monitored via another method suitable for the application.

Figure 10A:
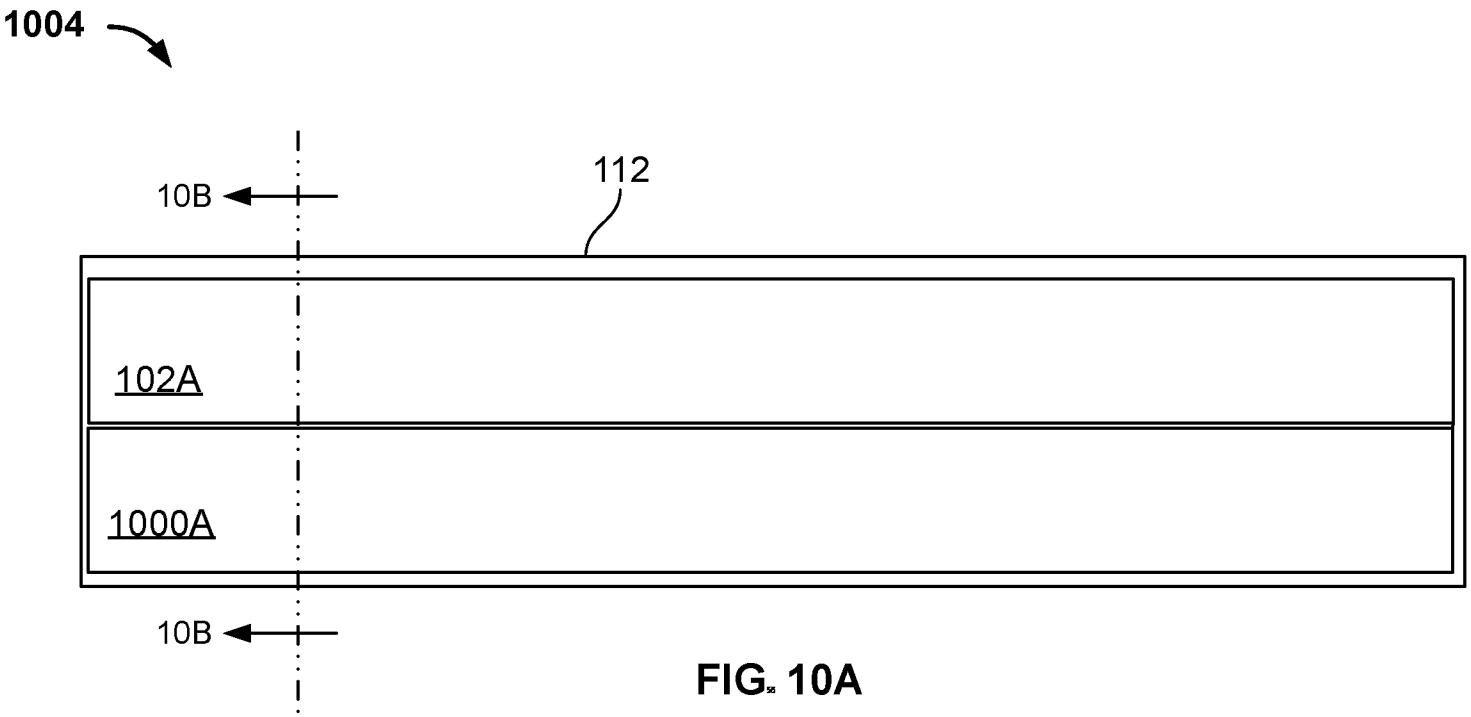
FIG. 10A is a cross sectional side view of another example configuration of components of a mattress system.
Figure 10B:
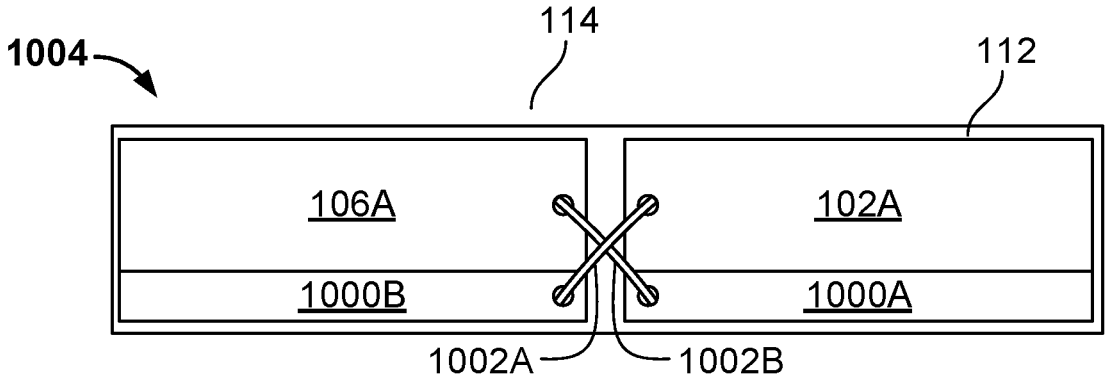
FIG. 10B is a cross section head end view of the example configuration of components of the mattress system in FIG. 10A.

FIG. 10A is a cross sectional side view of another example configuration of components of mattress system 1004 that includes the air chamber 102A, the air chamber 106A (shown in FIG. 10B), a lower air chamber 1000A, a lower air chamber 1000B (shown in FIG. 10B), and a cover 112. The lower air chamber 1000A can be stacked with the air chamber 102A. Thus, the lower air chamber 1000A can be positioned below the air chamber 102A and above the mattress cover 112 or positioned between the air chamber 102A and another layer of the mattress system 1004 (such as a bottom foam layer, not shown). In the embodiment of FIGS. 10A and 10B, the air chambers 102A, 106A, 1000B, and 1000B are shown extending substantially a full length of the mattress 1004. In alternative embodiments, the air chambers 102A, 106A, 1000B, and 1000B can extend less than a full length of the mattress 1004, and can be combined with additional air chambers, foam supports, and/or other components positioned in the mattress 1004.

FIG. 10B is a cross sectional head end 114 view of the example configuration of components of the mattress system 1004 in FIG. 10A taken along section line 10B-10B in FIG. 10A. In this view of the mattress system 1004, the lower air chamber 1000A is stacked beneath the air chamber 102A. The lower air chamber 1000B is stacked beneath the air chamber 106A. The air chamber 102A can be fluidly connected via a hose 1002A (or other suitable connector) to the air chamber 1000B. The air chamber 106A can be fluidly connected via a hose 1002B (or other suitable connector) to the lower air chamber 1000A. This cross connectivity configuration can be advantageous to maintain a relatively uniform level of a sleep surface across both sides of the mattress system 1004, even when each side is adjusted to differing pressure settings. For example, a user can deflate the air chamber 102A to a low pressure setting while another user can inflate the air chamber 106A to a high pressure setting. Despite the difference in pressure settings, cross fluid connection via the hoses 1002A and 1002B can provide for balancing out the sleep surface.

When both sides of the mattress system 1004 have relatively similar firmness, the mattress system 1004 can be relatively flat or even across the sleep surface. In some cases, one user can reduce firmness in the air chamber 102A while another user can increase firmness in the air chamber 106A. Without the cross fluid connection via the hoses 1002A and 1002B, the sleep surface of the mattress system 1004 may be uneven, such that the side of the mattress system 1004 having the air chamber 106A (which has been adjusted to be firmer) can be taller in height than the side of the mattress system 1004 having the air chamber 102A (which has been adjusted to be relatively less firm). This uneven sleep surface can be undesirable for users of the mattress system 1004 due to comfort and/or aesthetics and may reduce overall sleep quality of the users.

With cross fluid connection via the hose 1002B, for example when the user increases firmness in the air chamber 106A, firmness in the lower air chamber 1000A can similarly be increased to raise (or to help maintain) a height of the side of the bed having the air chamber 102A. The user may not feel the increased pressure of the lower air chamber 1000A since the less firm air chamber 102A is stacked on top of the lower air chamber 1000A, but both sides of the mattress system 1004 can have a relatively flat or even sleep surface. Likewise, when the user decreases firmness in the air chamber 102A, with cross fluid connection via the hose 1002A, firmness in the lower air chamber 1000B can similarly decrease to lower (or to help maintain) a height of the side of the bed having the air chamber 106A. The user may not feel the decreased pressure of the lower air chamber 1000B since it is stacked beneath the firmer air chamber 106A, but both sides of the mattress system 1004 can have a relatively flat or even sleep surface.

In some implementations, the mattress system 1004 may have the air chambers stacked as shown in FIGS. 10A-B without fluid connection. In other words, the air chamber 102A may not be fluidly connected via the hose 1002A (or other suitable connector) to the air chamber 1000B. Likewise, the air chamber 106A may not be fluidly connected via the hose 1002B (or other suitable connector) to the lower air chamber 1000A. Such a configuration can still be beneficial to maintain a relatively even or flat sleep surface for the mattress system 1004. This configuration can maintain a relatively even or flat sleep surface because one or more users can set unique pressure settings in each of the air chambers 102A, 106A, 1000A, and 1000B. For example, the user can input preferred pressure settings for one or more of the air chambers 102A, 106A, 1000A, and 1000B into a mobile application presented at a user device. Input provided in the mobile application can be transmitted to components of the mattress system 1004, such as a pump controller, in order to implement the pressure settings. The user can also input preferred pressure settings for any of the air chambers 102A, 106A, 1000A, and 1000B using a remote control that is in communication with the mattress system 1004. Sometimes, the pump of the mattress system 1004 can be configured to calculate optimal pressure settings for the lower air chambers 1000A and 1000B in order to maintain a relatively even or flat sleep surface regardless of pressure setting adjustments that the user makes to the air chambers 102A and/or 106A. The pump can also use a lookup table to determine optimal pressure settings for the lower air chambers 1000A and 1000B in order to maintain a relatively even or flat sleep surface.

While this specification contains many specific implementation details, these should not be construed as limitations on the scope of the disclosed technology or of what may be claimed, but rather as descriptions of features that may be specific to particular embodiments of particular disclosed technologies. Certain features that are described in this specification in the context of separate embodiments can also be implemented in combination in a single embodiment in part or in whole. Conversely, various features that are described in the context of a single embodiment can also be implemented in multiple embodiments separately or in any suitable subcombination. Moreover, although features may be described herein as acting in certain combinations and/or initially claimed as such, one or more features from a claimed combination can in some cases be excised from the combination, and the claimed combination may be directed to a subcombination or variation of a subcombination. Similarly, while operations may be described in a particular order, this should not be understood as requiring that such operations be performed in the particular order or in sequential order, or that all operations be performed, to achieve desirable results. Particular embodiments of the subject matter have been described. Other embodiments are within the scope of the following claims. For example, in some embodiments the mattress 100 can include more or fewer foam structures and/or air chambers than those illustrated. Moreover, in some embodiments the mattress 100 can include additional features not depicted, such as coil springs, comfort layers, sensors, or other support structures.

What is claimed is:

1. A mattress comprising:

a first air chamber;

a second air chamber stacked directly beneath the first air chamber, wherein the second air chamber is fluidly connected to the first air chamber, wherein the first air chamber and the second air chamber have a common internal pressure when a user lies on the mattress; and a support stacked beneath the first air chamber and positioned between the second air chamber and a foot end of the mattress.

2. The mattress of claim 1, further comprising a foam layer positioned at a top surface of the mattress above the first air chamber.

3. The mattress of claim 1, wherein the first air chamber extends across a length of the mattress from a head end to the foot end of the mattress.

4. The mattress of claim 1, wherein the second air chamber is positioned at a shoulder region of the mattress.

5. The mattress of claim 1, and further comprising a hose or other suitable connector configured to extend between the first air chamber to the second air chamber and an air pump configured to be fluidly connected to one or more of the first air chamber and the second air chamber, wherein decreasing the common internal pressure in the first air chamber and the second air chamber causes the support stacked beneath the first air chamber and positioned between the second air chamber and the foot end of the mattress to increase support at a lumbar region of the mattress.

6. The mattress of claim 1, wherein one or more additional supports are positioned beneath the first air chamber and between at least one of (i) the second air chamber and a head end of the mattress, (ii) the second air chamber and the support, and (iii) the support and the foot end of the mattress.

7. The mattress of claim 1, further comprising a third air chamber stacked beneath the first air chamber and positioned between the support and the foot end of the mattress, wherein the third air chamber is positioned at a hip region of the mattress.

8. The mattress of claim 1, wherein an additional support is positioned beneath the second air chamber and the support and configured to extend across a length of a bottom surface of the mattress.

9. The mattress of claim 1, further comprising a foam rail structure including a head portion, a foot portion, and first and second side portions, the foam rail structure stacked beneath the first air chamber and configured to extend around a perimeter of the mattress to surround the second air chamber and the support.

10. The mattress of claim 9, wherein the second air chamber extends from a location adjacent to an inner surface of the head portion of the foam rail structure to a shoulder region of the mattress.

11. The mattress of claim 9, wherein the support extends from a location adjacent to the second air chamber to a location adjacent to an inner surface of the foot portion of the foam rail structure.

12. The mattress of claim 1, wherein the support comprises a rectangular open cell foam cushion positioned between the second air chamber and the foot end of the mattress at a location exterior to the second air chamber.

13. The mattress of claim 1, further comprising a first section extending longitudinally between a head end and the foot end of the mattress and extending laterally between a left side and a midline of the mattress, and a second section extending longitudinally between the head end and the foot end of the mattress and extending laterally between a right side and the midline of the mattress, wherein the first section comprises the second air chamber and the support, and the second section comprises a third air chamber and a second support positioned between the third air chamber and the foot end of the mattress, wherein the first air chamber extends across a top surface of the first section and the second section.

14. The mattress of claim 13, wherein:

the second air chamber and the third air chamber have a different internal pressure, and the support within the first section has a first firmness level and the second support within the second section has a second firmness level, wherein the first firmness level is different than the second firmness level.

15. The mattress of claim 1, further comprising a first section extending longitudinally between a head end and the foot end of the mattress and extending laterally between a left side and a midline of the mattress, and a second section extending longitudinally between the head end and the foot end of the mattress and extending laterally between a right side and the midline of the mattress, wherein the first section comprises the first air chamber, the second air chamber, and the support, and the second section comprises a third air chamber, a fourth air chamber, and a second support positioned directly between the fourth air chamber and the foot end of the mattress, wherein the first air chamber extends across a top surface of the first section and the third air chamber extends across a top surface of the second section.

16. The mattress of claim 15, wherein the first air chamber and the third air chamber are fluidly connected via a first hose or other suitable connector to share a first common pressure and the second air chamber and the fourth air chamber are fluidly connected via a second hose or other suitable connector to share a second common pressure, wherein the first common pressure is different than the second common pressure.

17. A mattress comprising:

a first air chamber positioned on a first side of the mattress;

a second air chamber positioned on a second side of the mattress;

a first lower air chamber positioned directly under the first air chamber, wherein the first lower air chamber is fluidly connected with the second air chamber such that the first lower air chamber and the second air chamber share a first common pressure; and a second lower air chamber positioned directly under the second air chamber, wherein the second lower air chamber is fluidly connected with the first air chamber such that the second lower air chamber and the first air chamber share a second common pressure.

18. The mattress of claim 17, and further comprising one or more air pumps configured to be fluidly connected to one or more of the first air chamber, the second air chamber, the first lower air chamber, and the second lower air chamber, wherein each of the first air chamber and the second air chamber are fluidly independent and independently adjustable.

19. The mattress of claim 17, and further comprising one or more air pumps configured to be fluidly connected to one or more of the first air chamber, the second air chamber, the first lower air chamber, and the second lower air chamber, wherein the mattress is configured to have a relatively level top sleep surface even when pressure is adjusted in the first air chamber and the second lower air chamber but not in the second air chamber and the first lower air chamber.

20. The mattress of claim 17, wherein the first air chamber is directly fluidly connected to the second lower air chamber and wherein the second air chamber is directly fluidly connected to the first lower air chamber.

21. The mattress of claim 17, wherein the first air chamber is connected via a first hose or other suitable connector to the second lower air chamber and wherein the second air chamber is connected via a second hose or other suitable connector to the first lower air chamber.

22. The mattress of claim 17, wherein the first air chamber is not fluidly connected to the first lower air chamber, wherein the first air chamber is not fluidly connected to the second air chamber, and wherein the second air chamber is not fluidly connected to the second lower air chamber.

23. The mattress of claim 1, further comprising a hose or other suitable connector configured to extend between the first air chamber to the second air chamber with no valve between the first air chamber and second air chamber.

* * * * *